United States Patent [19]

Kwasnoski et al.

[11] 4,211,608

[45] Jul. 8, 1980

[54] COKE PUSHING EMISSION CONTROL SYSTEM

[75] Inventors: Daniel Kwasnoski, Hellertown; Carl R. Symons, Bethlehem, both of Pa.

[73] Assignee: Bethlehem Steel Corporation, Bethlehem, Pa.

[21] Appl. No.: 952,917

[22] Filed: Oct. 19, 1978

Related U.S. Application Data

[63] Continuation-in-part of Ser. No. 837,071, Sep. 28, 1977, abandoned.

[51] Int. Cl.[2] ..... C10B 39/14; C10B 45/00; C10B 57/00

[52] U.S. Cl. ..... 201/41; 201/1; 202/263

[58] Field of Search ..... 201/39, 41, 1; 202/263

[56] References Cited

U.S. PATENT DOCUMENTS

| | | | |
|---|---|---|---|
| 3,645,308 | 3/1976 | Jakimowicz et al. | 202/263 |
| 3,647,636 | 3/1972 | Helm | 202/263 |
| 3,734,834 | 5/1973 | Bricmont | 202/263 |
| 3,785,933 | 1/1974 | Edgar et al. | 202/263 |
| 3,801,472 | 4/1974 | Kemmetmueller | 202/263 |
| 3,801,473 | 4/1974 | Schoen et al. | 202/263 |
| 3,844,901 | 10/1974 | Roe et al. | 202/263 |
| 3,868,309 | 2/1975 | Sustarsic et al. | 202/263 |
| 3,951,751 | 4/1976 | Jakimowicz et al. | 202/263 |
| 3,972,782 | 8/1976 | Patton | 202/263 |
| 3,981,778 | 9/1976 | Schulte et al. | 202/263 |
| 4,019,963 | 4/1977 | Hanley | 202/263 |
| 4,029,192 | 6/1977 | Bender et al. | 202/263 |
| 4,039,394 | 8/1977 | Friend | 202/263 |
| 4,083,753 | 4/1978 | Rogers et al. | 202/263 |
| 4,096,041 | 6/1978 | Friend | 202/263 |
| 4,113,572 | 9/1978 | Manda et al. | 202/263 |
| 4,135,986 | 1/1979 | Cain et al. | 202/263 |
| 4,141,796 | 2/1979 | Clark et al. | 202/263 |

*Primary Examiner*—Bradley R. Garris

*Attorney, Agent, or Firm*—Joseph J. O'Keefe; Michael J. Delaney; Anson W. Biggs

[57] ABSTRACT

A process for controlling emissions resulting from hot coke being discharged from an oven of a battery of coke ovens from the beginning of discharge until the time when the coke arrives at a quenching station. The coke from the oven passes through a coke guide and a fume hood into an open-top, one-spot quenching car. The hood covers the car during discharge and is connected to an exhaust system, including a gas cleaning device, which draws air into the hood in an amount sufficient to control emissions and for combustion of the volatile matter and other combustibles emitted from the coke during the time coke is discharged into the quenching car and for a short period of time thereafter. During the movement of the open-top, one-spot quenching car from under the hood to the quenching station, the visible emissions given off by the hot coke are less than 40% opacity.

The process can also be practiced with one-spot quenching cars of a different design, including a covered one-spot car that receives coke through an opening in the car. Associated with the car is a gas exhaust-cleaning system which, as hot coke is discharged from an oven into the car, operates at a predetermined rate to draw air into the car in an amount sufficient to control emissions and for combustion of volatile matter and other combustibles emitted from the coke.

99 Claims, 10 Drawing Figures

COKE PUSHING EMISSION CONTROL SYSTEM

CROSS REFERENCE TO RELATED APPLICATIONS

This application is a continuation-in-part of U.S. Application Ser. No. 837,071 filed Sept. 28, 1977, and now abandoned.

BACKGROUND OF THE INVENTION

Recent concern about the environment has accelerated efforts by industry and government throughout the world to seek solutions for pollution problems applicable to air and water. The present invention relates to a process for improving the quality of air in and near coke plants by controlling the emissions which normally arise when coke is pushed from a coke oven.

Coke is produced by heating coal in the absence of air in by-product ovens that are designed and operated to collect volatile products given off by the coal during the coking process. The ovens are built of refractory brick, are long and narrow and tapered from one end to the other, i.e. narrow at one end and slightly wider at the other end, so that coke can be easily pushed from the ovens. The ends of each oven are equipped with removable refractory-lined doors that are positioned in place and sealed, either by self-sealing devices or a sealant, during the coking process. Coal is charged to an oven through several roof openings called charging holes that are closed by cast iron lids after the oven is charged. A plurality of ovens built in side-by-side relationship form a structure called a battery, which may comprise as many as eighty or more ovens. The side of a battery at the narrow ends of the ovens is called the "pusher-side" and the opposite side of the battery at the wider ends of the ovens is called the "coke side". Each side of a battery is equipped with a bench, which serves as a working platform, at an elevation above ground level but below that of the bottoms of the ovens. One or more batteries is referred to as a coke plant, and associated with such a plant is one or more coke quenching stations, the locations of which depend upon the relative positions of the batteries.

The operation of a coke oven battery is supported by several large mobile machines. Even oven is designed to take a definite volume of coal that is charged from a larry car which operates on rails that extend longitudinally of the top of the battery. At ground level and extending longitudinally of the pusher side of the battery, but independent from it, is a track upon which a pusher machine travels. The pusher machine is usually a combination door extractor, leveler and pusher. The door extractor removes a pusher side door from sealing engagement with an oven, holds the door while the oven is pushed and then repositions the door on the oven. The leveler is run through an oven a short distance from its top shortly after the oven is charged with coal to level the coal. The pusher includes a large reciprocating beam with a ram or enlarged head and is extended through the oven from the narrow pusher side end through the wider coke side end to force the coke from the oven at the end of each coking cycle. Extending longitudinally of the coke side of the battery and on the coke side bench is a door extractor machine, which operates in a similar fashion to the one on the pusher side and which positions a coke guide that is coupled to the door machine. The coke guide is aligned with an oven from which coke is pushed and provides a passage for the hot coke, across the coke side bench, before it drops into the quenching car. At ground level and extending longitudinally of the coke side of the battery, but independent from it, is a track upon which a quenching car travels. The track extends to a quenching station where hot coke in the quenching car is quenched with large volumes of water.

For many years the typical coke oven built in the United States had a coking volume of about 500 cubic feet, a coking capacity of about 9 tons and was about 37 feet long, 10 feet high, and had an average width of about 18 inches. The normal coking time or coking cycle for coke in such an oven was about 18 hours or a coking rate of about an inch an hour. The quenching car serving such a battery had an open top, was slowly moved during the discharge of coke from an oven into the car, was designed to catch a relatively uniform bed of coke about two feet thick on the sloping bottom of the car, and was about 40 feet long. The car was equipped with power operated gates on the side of the car farthest from the battery and at the lower side of the sloping bottom. The gates were closed during the discharge of coke into the car and while it moved to and from the quenching station and were opened to discharge coke from the car. Holes or slots in the gates permitted water not evaporated during the coke quenching process to drain from the car during and after quenching.

Most modern coke oven batteries built in the world during the past fifteen years have ovens substantially larger than those built earlier to take advantage of labor savings associated with the operation of large batteries. A large oven may have a coke volume of about 1400 cubic feet and a coke capacity of about 23 tons or more. The ovens may have a length of about 50 feet, a height of 20 feet or more and an average width of about 18 inches. Like the older batteries, the modern ones have a normal coking time or coking cycle of about 18 hours, i.e. a coking rate of about an inch an hour. The quenching car serving a battery of large ovens was initially a larger version, possibly 65 to 75 feet long, of the older moving car. However, during the past few years there has been a trend toward a quenching car that is designed and operated in a different manner than the moving car. The new quenching car is designed to receive the entire volume of coke discharged from an oven while the car remains stationary and is referred to as a single-position or one-spot car. A one-spot car may have a length of about 20–25 feet, substantially shorter than the moving coke cars of earlier design.

Government agencies have established regulations that define acceptable limits for pollutants discharged into the air, and industry is seeking ways to comply with such regulations. One such regulation states: "No person shall operate any equipment so as to produce, cause, suffer, or allow smoke or other visible emissions in excess of 40 percent opacity for more than a cumulative total of 15 minutes in any 24 hour period." An accepted visual method for determining opacity for air pollutants is by the RINGELMANN system, which is described in "Air Pollution Handbook", edited by Magill, Holden and Ackley, McGraw-Hill Book Co., Inc., 1956, with particular reference to section 6.7, pages 6–33 to 6–36, which section is hereby incorporated by reference. Opacity rating is defined in "Industrial Pollution Control Handbook", edited by Herbert F. Lund, McGraw-Hill, Inc., 1971, Glossary, p. 21, as "(A) measurement of the opacity of emissions, defined as the apparent obscuration of an observer's vision to a degree equal to the apparent obscuration of smoke of a given rating on the Ringelmann chart." Smoke emission standards limit emissions in terms of smoke density on the Ringelmann scale, the scale numbers varying on a scale from 0 to 5 and corresponding to a "percent blackness" of 0 to 100.

In order to comply with such regulations industry has directed substantial efforts toward the reduction of emissions from coke plants. Those emissions may be categorized as intermittent or continuous in nature, and this invention is directed to the reduction of intermittent emissions, specifically those associated with coke oven pushing operations. The pushing operation may be defined as the operation by which hot coke is removed from a coke oven and transported to a quenching station, beginning when the coke side door is first removed from a coke oven and continuing until the quenching of hot coke is commenced. Pushing emissions may be defined as any air contaminant, particularly visible smoke and fine solid particles of coke or incompletely coked coal, which is generated by or results from the pushing operation.

Emissions vary widely from battery to battery and relate to the battery age, design, maintenance and operation, particularly charging and heating practices and the allotted coking time cycle. Emissions are caused by a variety of factors. Coke pushed from any oven crumbles as the coke falls from the guide into the quenching car producing grit or fine particles in varying amounts. Coke from the corners of an oven includes some incompletely coked coal and tar that burns and releases smoke as the coke is pushed from the oven. Extreme temperature difference between hot coke and the outside air produces strong air currents that carry particles of coke and uncoked coal into the air and accelerate the burning of combustible solids and gases. Finally, as a quenching car of hot coke travels from the oven from which the coke was discharged to the quenching station, the passage of air through the coke causes air currents that carry off fine particles of grit and continue combustion of the hot coke.

No reference to coke oven pushing emissions would be complete without a discussion of coke quality. The length of coking time determines to a large degree the "quality of coking" which is defined as the "greenness" of the coke pushed from an oven. Green coke is coke from which the volatile matter has not been completely distilled by the coking process and is evidenced by heavy black emissions rising from a coke quenching car that is receiving hot coke pushed from an oven. An experienced observer is able to make a judgement as to the quality of coke pushed from an oven based on the degree of "greenness" as e.g. very green, green or moderately green as compared to a "clean" push, i.e. one giving off little or no visible emissions. An important factor to be considered with respect to green pushes is that they can generate combustibles such as CO and $H_2$ in explosive concentrations when confined and contacted with air. For example 6 mol percent of CO and $H_2$ in equal parts or 4% $H_2$ are explosive concentrations. Any system for controlling coke oven pushing emissions must be designed to control emissions created during the discharge of green coke from an oven.

Numerous systems and devices have been suggested for controlling coke oven pushing emissions. Reference is made to two papers, "Coke-Oven Air Emission Abatement", Iron and Steel Engineer, October 1972, pp. 86–94 and "Control of Coke-Oven Emissions", Ironmaking and Steelmaking, 1975 Volume 2 Number 3, pp. 157–187, which describe several such systems including the following.

(1) Bench-mounted self-contained hood system includes a coke guide associated with a hood that is connected through ducts to a gas scrubber. The gas scrubber is either mounted on the coke guide or a car coupled to the guide, and the hood is designed to extend over an open-top moving quenching car, for its full width and a portion of its length, to collect emissions that arise when hot coke is discharged into the quenching car.

(2) Hot car mounted enclosure and hood system, referred to as a "mobile" system, includes a one-spot quenching car upon which is mounted a hood that is designed to fully enclose the top of the quenching car but has an opening that cooperates with the end of a coke guide. The opening permits coke pushed from the guide to fall into the car when coke is discharged from an oven. Emissions from the coke are withdrawn from the quenching car through ducts connected to a scrubber system that is mounted either on the car or a coupled trailer.

(3) Fixed duct hood and scrubber system, referred to as a "land-based" system, includes a separate emission collecting main that extends along the coke side of a battery and has a valved outlet adjacent each oven and a fan and scrubber associated with the main. A hood and ductwork are associated with the coke guide and connect with the collecting main during the time when coke is being pushed from an oven into a moving open-top quenching car which covers the width of the car but only a portion of its length.

While each of the above systems has been somewhat successful in reducing emissions, the following disadvantages are known:

(1) The bench-mounted self contained hood system is large and heavy and extends over a significant portion of the coke side bench. Furthermore, the efficiency of emission collection is greatly affected by the large gap between the bottom of the hood and the moving open-top sloping-bottom quenching car and there is no demonstrated way to control emissions from the hot coke from a normal coking cycle when the car moves from under the hood and travels to the quenching station.

(2) The mobile system car may have a length of 100 feet or longer. The system will be difficult to apply to existing coke plants where space is limited, the capital and operating costs are high and a special quenching system is required in conjunction with the enclosed-top one-spot quenching car. Mobile systems are just appearing in the United States and the special problems associated with the excessive car length, weight, and special quenching systems remain to be solved on a production basis.

(3) The land-based system emission collection efficiency is greatly affected by the large gap between the bottom of the hood and the moving open-top sloping-bottom quenching car and there is no demonstrated way to control emissions from the hot coke from a normal coking cycle when the car moves from under the hood and travels to the quenching station. In Japan where the land-based system is used extensively, the normal coking cycle is extended for a "soaking period" during which the coke is further heated in the oven to assure that all the volatile matter has been driven off and the coal is completely coked. The soaking period minimizes any pollutants being given off while the hot coke in a car moves to the quenching station, but there is a considerable production penalty associated with the soaking period. In plants where the bench mounted self-contained hood system and the land-based system have been tried the drafting and exhausting equipment has had to be enlarged, resulting in even higher operating costs, in an attempt to improve emission collecting efficiency.

SUMMARY OF THE INVENTION

It is therefore an object of this invention to provide a system for controlling coke oven pushing emissions that will avoid the above mentioned disadvantages.

It is another object of this invention to provide a system for controlling coke oven pushing emissions during the pushing operation that makes use of an open-top coke quenching car to move hot coke from an oven to a quenching station without giving off emissions in excess of 40% opacity.

It is still another object of this invention to provide a system for controlling coke oven pushing emissions during the pushing operation that makes use of a one-spot coke quenching car, having an opening therein to receive hot coke from a coke oven and to move such hot coke to a quenching station.

It is another object of this invention to provide a system for controlling coke oven pushing emissions that arise from pushes of clean as well as green coke produced during a normal or shorter than normal coking cycle.

It is a further object of this invention to provide a system for controlling coke pushing emissions that will be capable of accomplishing the above objects economically and more efficiently than is accomplished by use of systems representing the best technological information heretofore available.

The present invention accomplishes these objects by a system that includes an open-top one-spot quenching car, a coke guide and a fume hood which is designed to cover the quenching car and which connects with gas exhaust and cleaning apparatus. An alternate embodiment of the invention includes a system that employs a one-spot coke quenching car having an opening therein to receive hot coke from a coke oven and having a connection to gas exhaust and cleaning apparatus. During the period that hot coke is pushed from an oven through the coke guide into the quenching car and for a short interval after such period, air is drawn by an exhaust apparatus and cleaning apparatus in an amount sufficient: (a) for combustion of the volatile matter and other combustibles emitted from the coke, (b) to insure that the incomplete combustion products are at a concentration below the lower explosive limits, (c) to prevent overheating of the system and (d) to accommodate surges or puffs of gas that may occur as the coke crumbles and falls into the car, whereby the quenching car can travel from the oven to a quenching station without the hot coke giving off substantial emissions.

PREFERRED EMBODIMENTS METHOD OF OPERATION

Figure 2:
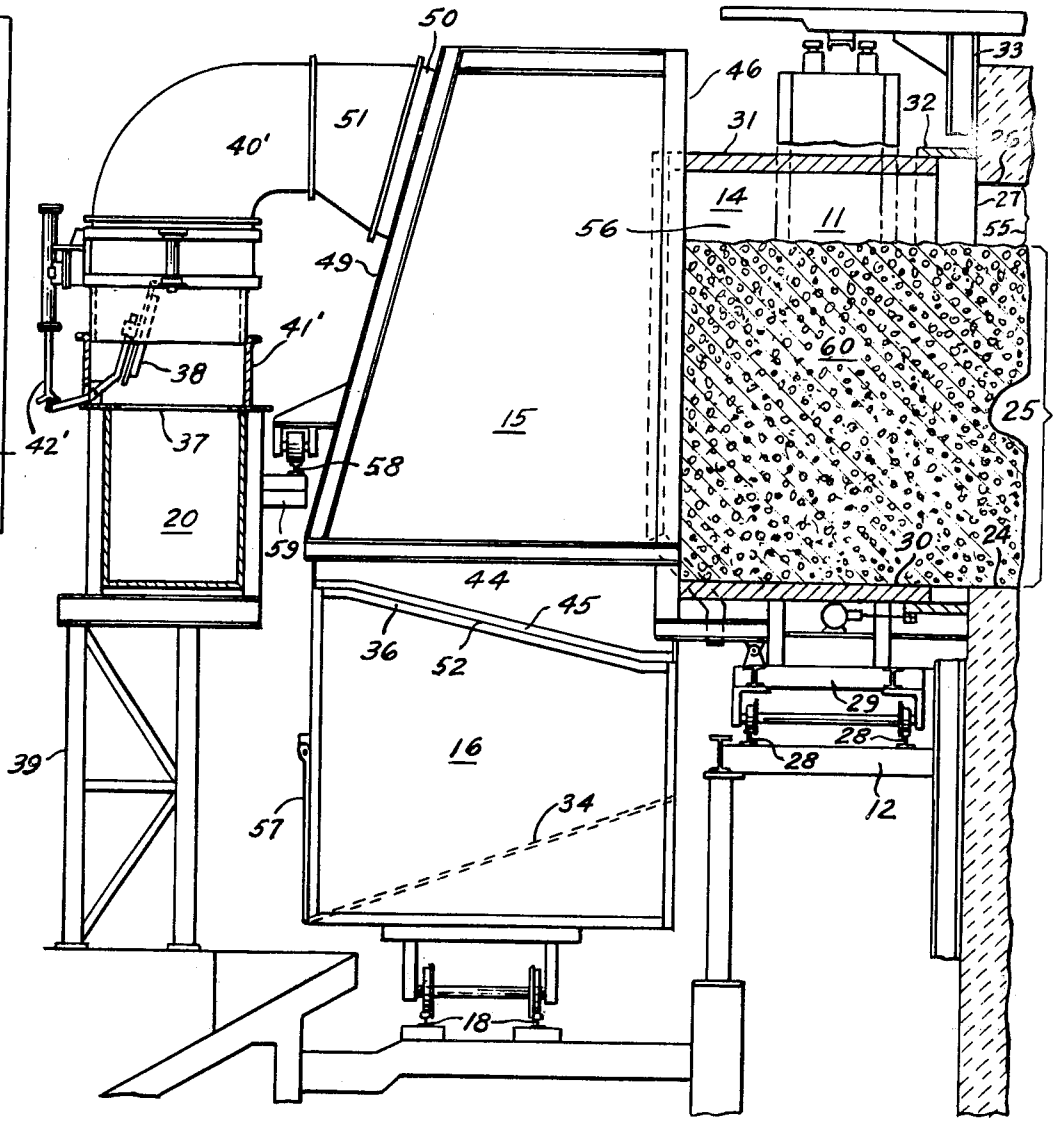
FIG. 2 is a side elevation of the apparatus of FIG. 1 connected to a collecting main shown in section and associated with a coke guide and coke oven also shown in section.
Figure 1:
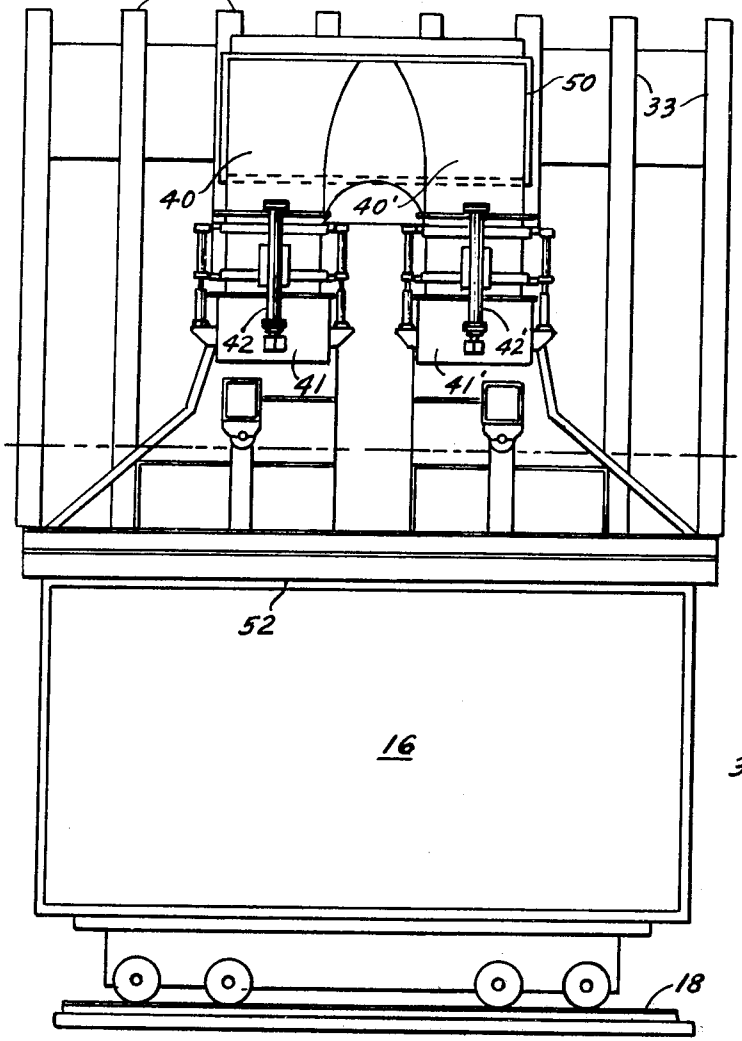
FIG. 1 is a schematic front elevation of apparatus adapted for use with the instant invention.

In the method of this invention for controlling coke oven pushing emissions using the apparatus shown in FIGS. 1–6 an oven 11 having chamber 25 with a nominal height of 6 meters, an average width of 18 inches and a length of about 48 feet is charged with 1392 cu. ft. volume of coal to a coal line of 19 ft. 3 inches above oven floor 24 and about 13 inches below oven top 26. The coal is heated in the absence of air for a normal coking time or coking cycle of about 18 hours and produces about 23.5 tons of coke. During the coking cycle gases driven from the coal pass through the space or passageway 55 between the top of the coal and oven top 26 and into the battery gas collecting system.

After completion of the coking cycle, the oven doors, not shown, are removed from the pusher side end, not shown, and the coke side end 27 of oven chamber 25. Coke guide 14 on coke guide car 29 is moved into alignment with oven chamber 25, and coke guide transition section 32 is moved into position against coke side oven end 27. In moving coke guide 14, hood 15, which has its battery side 46 secured to the outer end of guide 14 is also moved into position in alignment with oven chamber 25, and double duct assembly 40—40′ is moved into position above two ports, 37 of collecting main 20. Once guide 14 and hood 15 are in alignment with oven chamber 25, one-spot open-top quenching car 16 is moved into position directly beneath lower portion 44 of hood 15 so that the top flat bars 36 of car 16 and the flat bars 45 of the lower portion 44 of hood 15 are in close proximity.

When used herein, an open-top coke quenching car is a car where an area equal to the length and width of the entire top of the car is open to the atmosphere or if necessary or desirable, as little as 30% of such area can be open to the atmosphere.

When guide 14, hood 15 and quenching car 16 are all in position telescoping duct connectors 41—41′ at the lower ends of hood ducts 40—40′ are dropped into engagement with ports 37 of collecting main 20 and port valve mechanism 42—42′ is activated to open port valves 38, as best shown in FIG. 2. Fan 22, FIG. 4, at the end of collecting main 20 is in operation continuously so that the opening of port valves 38 of ports 37 causes air to be drawn through the coke guide 14 and hood 15 and connecting ductwork 50, 51, 40—40', collecting main 20, gas cleaning equipment 21 and fan 22 after which the cleaned gases are exhausted to the atmosphere. Gas cleaning equipment 21 and fan 22 are standard equipment and well known to those skilled in the art.

With the emission control system in operation, the discharge of coke mass 60 from oven chamber 25 is started. The pusher ram, not shown, is brought into contact with the coke at the pusher side end of oven chamber 25 and the ram is slowly moved through the chamber, out through coke side end 27 and partially through coke guide 14. The movement of the ram forces the coke from chamber 25, through coke guide transition section 32 and coke guide 14. At the end of guide 14 farthest from oven 27 the coke is no longer supported by guide 14 and crumbles and falls into quenching car 16 until the entire mass of coke from oven chamber 25 is deposited in car 16.

While the coke is being pushed from oven chamber 25, the exhaust created by fan 22 causes air to be drawn through chamber passageway 55 in the top of chamber 25, between the top of the coke mass 60 and the oven top 26, and connecting guide passageway 56 in top of coke guide 14, between the top of the coke mass 60 and the coke guide top 31, and into hood 15. At the same time, air is drawn through gap 52, between the quenching car top flat bars 36 and hood lower portion flat bars 45, and air opening 48 in hood battery side 46, and into hood 15. The air drawn into the hood, most of which occurs adjacent the lower portion of the hood, below the elevation of coke guide bottom 30, mixes in hood 15 with the emissions resulting from the discharge of coke into quenching car 16. The air and emissions are exhausted from hood 15 through outlet connection 50 located near the top of the hood 15 opposite the air opening 48 in hood 15 battery side 46 and on the vertical centerline of the oven thence through connecting ductwork 51, 40—40', 41—41', collecting main 20, through gas cleaning equipment 21 where contaminants in the gases are removed and the clean gases are exhausted to the atmosphere. It is desirable to position the exhaust offtake near the top of the hood to take advantage of the thermal rise of emissions from the hot coke mass with a minimum of exhaust needed to contain and collect these emissions. Positioning the offtake in hood 15 opposite the air opening 48 in hood-battery side 46 and on the vertical centerline of the oven insures good contact between the falling hot coke and the air drawn into the hood to facilitate dedusting of the coke as it falls into quench car 16.

After all of the hot coke has been discharged from oven chamber 25 into quenching car 16, the car is kept in position beneath hood 15 for a period of time, called a "dedusting period", while fan 22 continues to draw air into hood 15 and through the remainder of the system to capture any emissions that are given off while the quenching car 16 with its charge of hot coke is under hood 15. At the end of the dedusting period, locomotive 17 moves open-top quenching car 16 from underneath the fume hood 15 along tracks 18 to quenching station 19 without having the hot coke give off emissions in excess of 40% opacity, despite the fact that hot coke in the car is exposed to the atmosphere and gases are not being withdrawn from the hot coke. In station 19 the hot coke is quenched with large volumes of water and then car 16 is moved to a coke wharf, not shown, where the coke is discharged through car gates 57 onto the wharf.

DESCRIPTION OF THE APPARATUS

Figure 4:
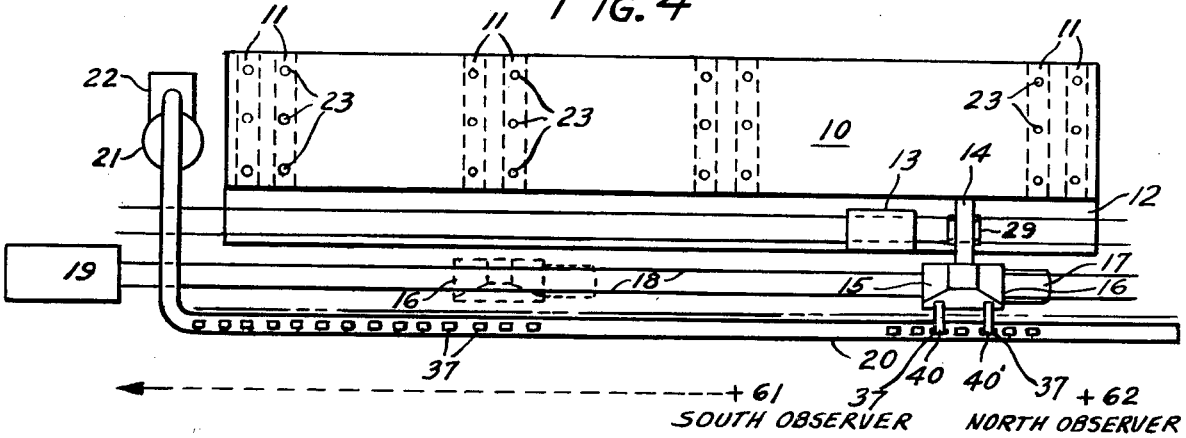
FIG. 4 is a schematic plan view of a coke oven battery and associated apparatus adapted for use with the instant invention.

Referring to the drawings, particularly FIG. 4, there is illustrated apparatus for practicing the invention which generally includes coke oven battery 10 having a plurality of parallel coke ovens 11, coke side bench 12, door machine 13, coke guide 14, hood 15, quenching car 16, quenching car locomotive 17, quenching car tracks 18, quenching station 19, collecting main 20, gas cleaning equipment 21 and induced draft fan 22.

Figure 3:
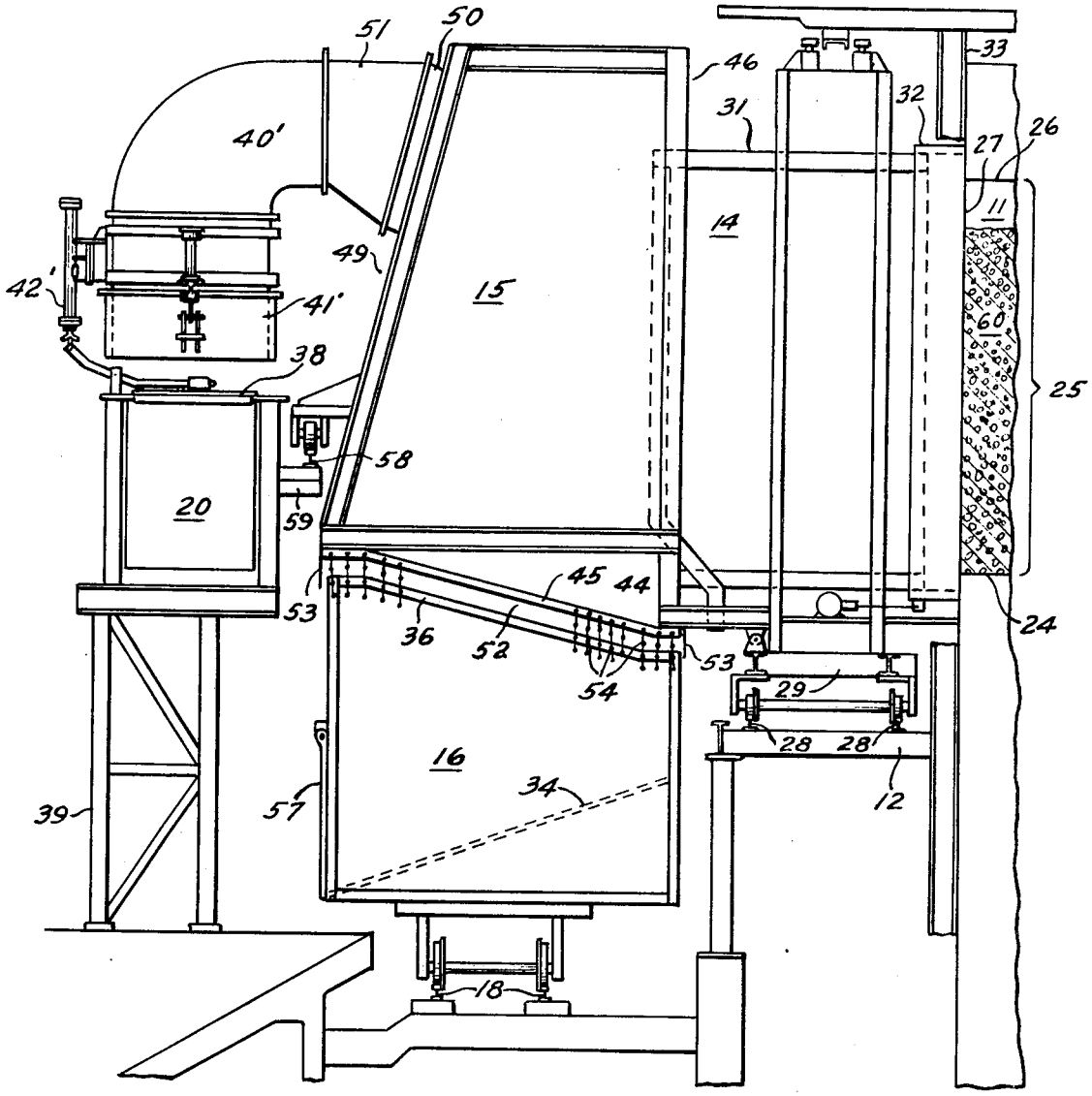
FIG. 3 is a view similar to FIG. 2 showing an alternate form of apparatus adapted for use with the instant invention.

Each oven 11 has top charging holes 23, shown in FIG. 4, and, as best shown in FIG. 3, a floor 24, coking chamber 25, top 26, and coke side oven end 27 from which a door, not shown, has been removed. Coke side bench 12 extends for the full length of battery 10 and supports coke guide tracks 28. Door machine 13 and coke guide car 29 that supports coke guide 14 ride on tracks 28. Door machine 13 is attached to coke guide 14 by a disconnecting coupler at such times as the coke guide car is moved along the coke side bench. Coke guide 14, which is open at both ends, includes bottom 30, which is at the same elevation as bottom 24 of coke oven 11, and top 31. Associated with coke guide 14 is transition section 32 that is power operated and which is movable into the space between the buckstays 33 of an oven and against the coke side oven end 27 to prevent spillage of coke that would otherwise take place in the gap between the coke guide and the oven end during pushing. The height and width of the inside of the coke guide are slightly larger than the height and width of oven chamber 25 so that a mass of coke 60 pushed from an oven chamber 25 easily passes through the coke guide while the coke is supported on the coke guide bottom 30.

Quenching car 16 is a one-spot, open-top quenching car, with a sloping bottom 34 and open top 35 that has flat bars 36 extending around the top periphery. Car 16 is sized to receive, while remaining stationary, the total volume of coke pushed from an oven 11. Quenching car 16 is positioned at an appropriate oven of battery 10 and moved to and away from quenching station 19 by means of quenching car locomotive 17.

Referring to FIGS. 3 and 4, on the opposite side of the quenching car track 18 from bench 12 is collecting main 20 that extends for the full length of battery 10 and connects with gas cleaning equipment 21 and induced draft fan 22 located at the end of the battery. A plurality of ports 37 are located in the top of the main, one opposite each oven, and associated with each port is valve 38. Collecting main 20 rests on supports 39. Extending along the battery side of collecting main 20 is a third rail 58 mounted on supports 59 secured to main 20.

Figure 5:
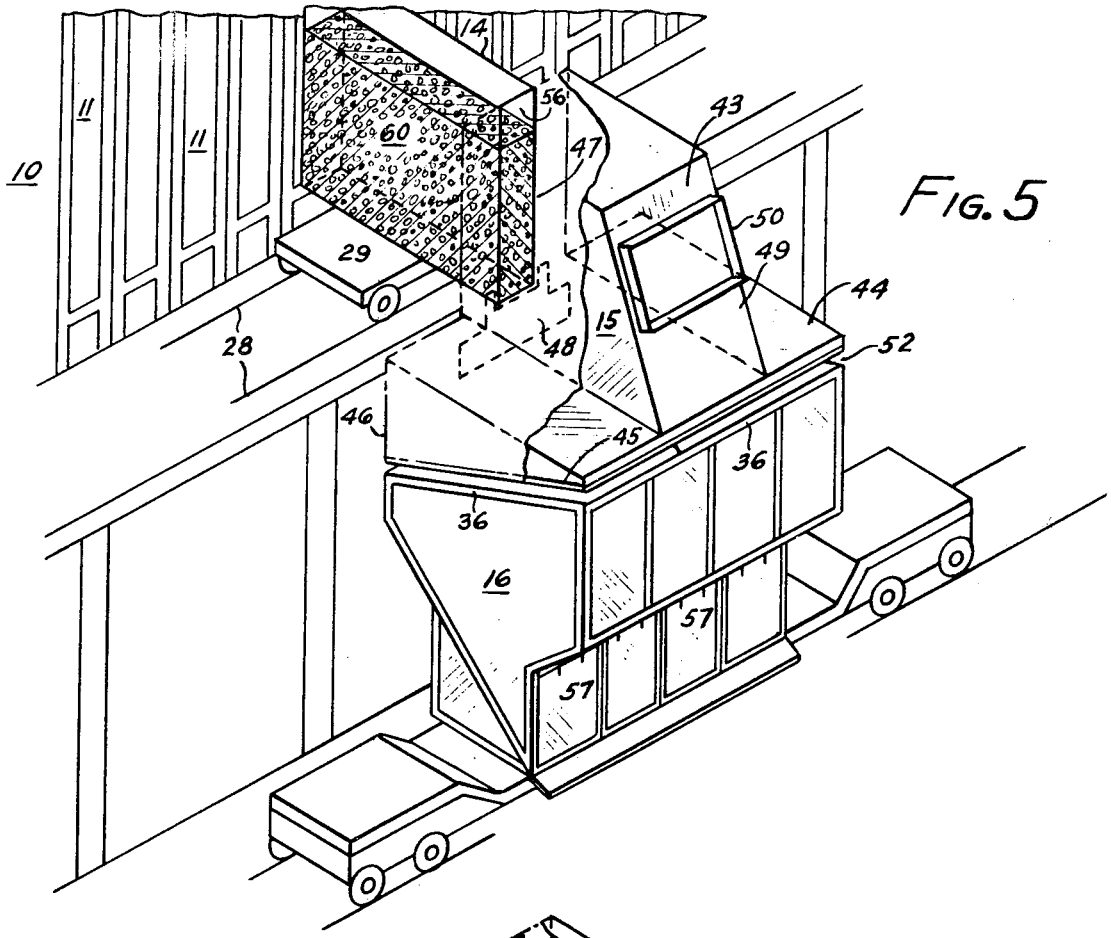
FIG. 5 is an isometric schematic view of the apparatus similar to that of FIG. 3, with a portion of the coke guide and hood cut away.
Figure 6:
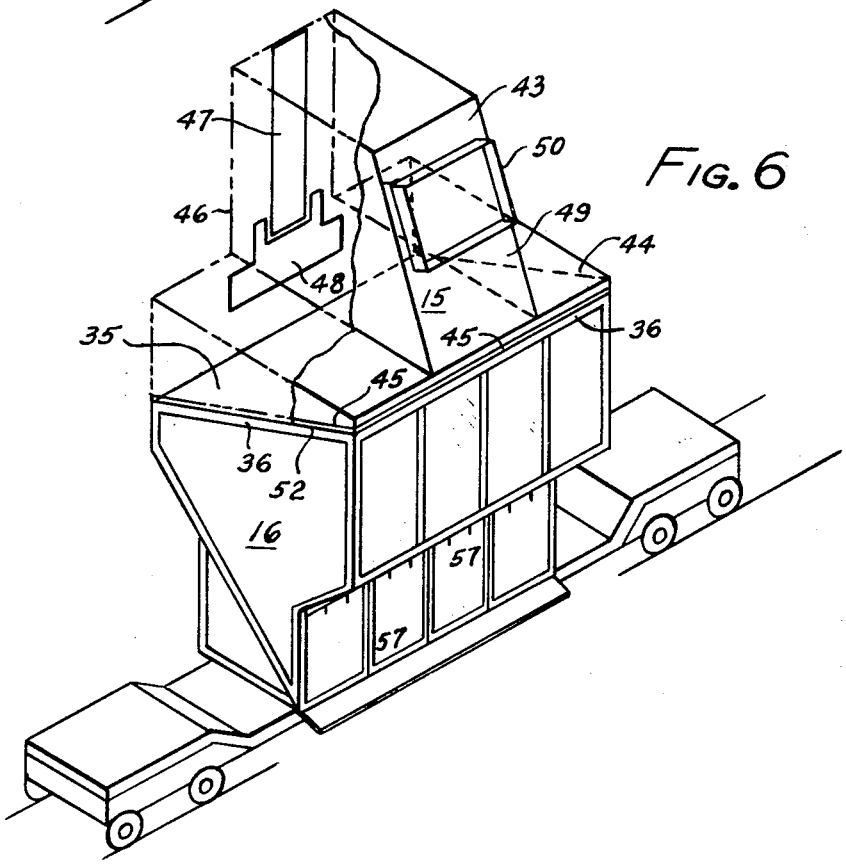
FIG. 6 is an isometric schematic view of apparatus similar to that of FIG. 2, with a portion of the coke guide and hood cut away.

Hood 15 is supported on its battery side 46 by coke guide 14 to which the hood is secured and on the collecting main side 49 by third rail 58. As best shown in FIGS. 5 and 6, hood 15 includes an upper portion 43 and a lower portion 44 that is open and around the bottom periphery of which extends flat bars 45. The peripheral dimensions of hood lower portion 44 correspond approximately to those of quenching car open top 35. In hood battery side 46 adjacent to the coke side bench is coke opening 47 in alignment with the opening of coke guide 14 and having approximately the same dimensions. Adjacent the bottom of coke opening 47 in side 46 is air opening 48. On the collecting main side 49 of the hood upper portion 43 and adjacent its top is flange outlet connection 50 located opposite the air opening 48 in hood 15 battery side 46 and on the vertical centerline of the oven. Extending outwardly from outlet connection 50 is transition section 51, shown in FIG. 3, that connects with double duct assembly 40—40'. At the lower ends of duct assembly 40 and 40' are telescoping duct connections 41 and 41' and port valve actuating mechanism 42 and 42'.

All of the above mentioned elements are standard items of equipment and well known to those skilled in the art.

Reference is made to two specific embodiments of the above mentioned equipment that are shown in FIGS. 2 and 6 and FIGS. 3 and 5, respectively. The embodiment shown in FIGS. 2 and 6 represents an ideal situation in which the quenching car peripheral top flat bars 36 are separated from the hood lower portion flat bars 45 by minimal gap or space 52. While a small or minimal gap is a desirable situation, it would be extremely difficult to achieve such a gap without a complex enclosure system or hood lower portion 44. The preferred embodiment of apparatus used in conjunction with the emission control system of this invention is best shown in FIGS. 3 and 5. In this system there is a gap or space 52 between the peripheral quenching car top flat bars 36 and the peripheral hood lower portion flat bars 45. The extent of the gap or space is determined by the clearance that is deemed necessary to provide continuous space passage between the quenching car and the hood. That clearance is determined by a number of factors including the maintenance of the cooperating equipment, the extent to which the quenching car tracks 18 and the coke guide tracks 28 and the third rail 58 supporting the hood are maintained level with respect to one another. It should be recognized that while a gap 52 as large as 4 to 6 inches may be necessary between hood 15 and quenching car 16, that gap can be shielded by closure plates 53 and chains 54 that extend downwardly from the lower sides of hood lower portion 44 and hang across gap 52.

The two embodiments described above vary in the location from which in-draft volume of air is drawn to guarantee capture of emissions, control leaks, lower the temperature of the gases and provide combustion air for volatile matter. The embodiment shown in FIG. 2 and FIG. 6 pictures an open coke guide which permits control air to be drawn into the fume hood 15 through a first opening or passageway 56 measuring about three square feet between the top of the coke in the coke guide and the top of the coke guide and a second air opening 48 of about six square feet in the side of the fume hood adjacent the coke oven and about at an elevation equal to the elevation of the bottom of the coke guide. In the embodiment of FIG. 2, there is substantially no gap 52 at the fume hood/coke receiver car interface. The alternate embodiment shown in FIG. 3 and FIG. 5 includes a fume hood which encloses the coke guide 14 with provisions for a gap 52 at the interface of fume hood 15 and coke receiver car 16 of about 3" to about 6". As shown in FIG. 5, control air is drawn into the fume hood 15 through a first opening 56 of about three square feet between the top of the coke in the enclosed coke guide and the top of the coke guide, a second opening 48 of about six square feet in the battery side 46 of the hood 15 adjacent the coke oven and about at an elevation equal to the elevation of the bottom of the coke guide and a third opening of about twenty-two square feet between the top of the car 16 and the bottom of the hood 15, i.e. gap 52.

During the test phase of development of the invention, opacity readings were taken using the Ringelmann system and recorded in Tables 1 and 3–3d inclusive which follow.

As shown in the tables this invention provides a method for controlling coke oven emissions during the pushing cycle of a coke oven wherein the opacity of the emissions does not exceed an opacity rating of 40 percent as determined by the Ringelmann system.

The Tables included hereinafter record the experimental data obtained using two forms of apparatus.

SPECIFIC EXAMPLES

For hot coke of a normal coking cycle, or shorter, pushed from a 6 meter oven of the size described above, it was found that a nominal exhaust gas flowrate of from about 24,000 scfmd to about 83,600 scfmd was required during the push and for a period of for about 30 to 135 seconds after completion of the push, i.e. the dedusting period, in order that the hot coke could be moved to the quenching station without giving off emissions having an opacity rating exceeding 40 percent. Since flowrate is a function of the amount of coke pushed from an oven, which is a function of its size, the flowrate per tone of coke pushed is between about 1000 and 3500. The dedusting period, i.e. the time for withdrawing emissions from hot coke under hood 15 is determined by the coking time. A clean push, which may result from a long coking time, i.e. longer than the normal coking time, may require no dedusting. However, for coke produced during a normal coking time, or shorter, a dedusting period of about 30 to 135 seconds is necessary.

The system of this invention resulted from a series of tests conducted on a battery of 6 meter ovens of the size described above, having an average capacity of 23.5 tons of coke which was pushed from the ovens in 35 seconds. The test apparatus included (1) an open-top one-spot coke receiving car mounted on a typical "low-boy" railroad car, (2) a removable hood, (3) a transition duct to which was hooked a water spray system, (4) a 68" diameter sampling duct, and (5) an exhaust fan equipped with variable damper device and a motor. The fan used for these tests was manufactured by Fuller Fan Co., Model No. 173. The fan was modified to deliver 150,000 acfm at 60° F. at a static pressure of 6½" w.g. The fan was belt driven by a 300 HP motor.

Table 1 records the observations of emissions generated when the apparatus shown in FIG. 3 including a 30 foot prototype open-top one-spot receiver car 16 having an interface gap 52 between the car 16 and hood 15 of 3" and 6" was used.

Tables 3–3d inclusive record the observations of emissions generated when a 22 foot prototype open-top one-spot receiver car, the apparatus shown in FIG. 2, was used with a minimal gap 52 between the car 16 and the hood 15.

The headings used in Tables 1 and 3–3d are defined as follows:

coking time—the time elapsed from charging to pushing of an oven during which carbonization of the coal takes place, exhaust gas flowrate (acfm)—the flowrate of the gas in cubic feet per minute as measured at the conditions existing at the inlet of the exhaust fan, i.e. temperature, pressure and water vapor content, exhaust gas flowrate (scfmd)—exhaust gas flowrate in cubic feet per minute (acfm) corrected to standard conditions, i.e. 70° F., 0% water vapor @ 29.92 in. of Hg. pressure, gas temperature, °F.—the temperature of the exhaust gases taken at the inlet to the fan, time car is under hood after completion of push—time in seconds that car 16 is under hood 15 after completion of push, N and S—refer to the positions of observers taking the opacity readings at positions 61 and 62 respectively, FIG. 4, coke at end of guide—just prior to coke falling into receiver car 16, completion of push—ram has pushed all the coke out of the oven into the receiver car 16, car under quench station—just prior to quenching spray.

TABLE 1

Summary of Visible Emissions Observations for 30 Foot Prototype Quench Car and Closed Coke Guide

| Test No. | 1 | | | 2 | | | 3 | | | 4 | | | 5 | | |
|---|---|---|---|---|---|---|---|---|---|---|---|---|---|---|---|
| Coking Time (hr.:min.) | 15:08 | | | 14:30 | | | 14:52 | | | 14:54 | | | 14:35 | | |
| Exhaust Gas Flow (acfm) | 106,400 | | | 100,830 | | | 111,400 | | | 104,800 | | | 106,800 | | |
| Exhaust Gas Flow (scfmd) | 82,250 | | | 62,500 | | | 55,600 | | | 61,600 | | | 69,300 | | |
| Duct Temp. (°F.) | 155 | | | 155 | | | 170 | | | 160 | | | 150 | | |
| Hood/Car Interface Gap (in.) | 3 | | | 3 | | | 3 | | | 6 | | | 6* | | |
| Time Car Under Hood After Completion of Push (sec.) | 105 | | | 90 | | | 60 | | | 60 | | | 30 | | |
| Phase of Pushing Sequence | Opacity Ratings Recorded Every 15 Seconds | | | | | | | | | | | | | | |
| | N. | S. | N. | S. | N. | S. | N. | S. | N. | S. | | | | | |
| Coke at End of Guide | 0 | 0 | 0 | 0 | 10 | 0 | 0 | 0 | 0 | 0 | | | | | |
| | 20 | 20 | 20 | 0 | 20 | 0 | 70 | 100 | 20 | 20 | | | | | |
| Completion of Push | 10 | 0 | 0 | 0 | 0 | 0 | 20 | 20 | 0 | 0 | | | | | |
| | 0 | 0 | 0 | 0 | 0 | 0 | 0 | 0 | | | | | | | |
| | 0 | 0 | 0 | 0 | 0 | 0 | 0 | 0 | | | | | | | |
| | 0 | 0 | 0 | 0 | 0 | 0 | 0 | 0 | | | | | | | |
| | 0 | 0 | 0 | 0 | | | | | | | | | | | |
| | 0 | 0 | 0 | 0 | | | | | | | | | | | |
| | 0 | 0 | | | | | | | | | | | | | |
| Hood Removed | 0 | 0 | 0 | 0 | 0 | 0 | 20 | 20 | 0 | 0 | | | | | |
| Car Traveling to Quench Sta. | | 0 | | 0 | | | | 20 | | 0 | | | | | |
| | | 0 | | 10 | | | | 10 | | 10 | | | | | |
| | | 0 | | 10 | | | | 10 | | 10 | | | | | |
| | | 0 | | 10 | | | | 10 | | 10 | | | | | |

TABLE 1-continued

Summary of Visible Emissions Observations for 30 Foot Prototype Quench Car and Closed Coke Guide

| | | | | | | | | | |
|---|---|---|---|---|---|---|---|---|---|
| | | 0 | 10 | | | | 10 | | 10 |
| | | 0 | 0 | | | | 10 | | 0 |
| | | 0 | 5 | | | | 10 | | 0 |
| | | 0 | 0 | | | | 0 | | 0 |
| | | 0 | 0 | | | | 0 | | 10 |
| | | 0 | 0 | | | | 10 | | 0 |
| | | 0 | 0 | | | | 10 | | 10 |
| | | 0 | 0 | | | | 0 | | 0 |
| | | 0 | | | | | 0 | | 0 |
| | | 0 | | | | | | | 0 |
| | | 0 | | | | | | | 0 |
| | | 0 | | | | | | | 0 |
| | | 0 | | | | | | | |
| | | 0 | | | | | | | |
| | | 0 | | | | | | | |
| | | 0 | | | | | | | |
| Car Under Quench Station | | 0 | 0 | 0 | 0 | 0 | 0 | 0 | 0 |

*6" gap is shrouded

TABLE 2

One-Spot Emission Control Tests Gas Analysis For 30' Prototype Car

| Test No. | 1 | 2 | | 3 | | 4 | | 5 | |
|---|---|---|---|---|---|---|---|---|---|
| Coking Time (hr.:min.) | 15:08 | 14:30 | | 14:52 | | 14:54 | | 14:35 | |
| Coking Quality | Moderate | Green | | Green | | Green | | Green | |
| Exhaust Gas Flowrate (scfmd) | 82,250 | 62,500 | | 55,600 | | 61,600 | | 69,300 | |
| | | Gas Analysis | | | | | | | |
| Time Taken (Secs) | NA | 15 | 25 | 15 | 25 | 15 | 25 | 15 | 25 |
| % CO | NA | ND | ND | ND | 0.28 | ND | ND | ND | ND |
| % $H_2$ | NA | NA | | NA | | NA | | NA | |
| % $O_2$ | NA | 14.64 | 13.41 | 14.51 | 12.75 | 14.62 | 14.80 | 8.61 | 13.16 |

Notes:
1 - Test No. refers to tests recorded in Table 1
2 - Gas samples were taken in the emissions collecting main adjacent the oven being pushed
3 - ND means "not detected"
4 - NA means "not analyzed"

TABLE 3

Summary of Visible Emissions Observations for 22 Foot Prototype Quench Car and Open Coke Guide

| Test No. | 1 | 2 | 3 | 4 | 5 |
|---|---|---|---|---|---|
| Coking Time (hr.:min.) | 18:15 | 18:3 | 18:9 | 19:45 | 15:58 |
| Exhaust Gas Flow (acfm) | 57,800 | 59,000 | 90,600 | 88,100 | 99,750 |
| Exhaust Gas Flow (scfmd) | 33,300 | 26,000 | 31,700 | 64,900 | 83,600 |
| Duct. Temp. (°F.) | 325 | 450 | 600* | 135 | 132 |
| Time Car Under Hood After Completion of Push (sec.) | 135 | 120 | 75 | 75 | 120 |
| Phase of Pushing Sequence | Opacity Ratings Recorded Every 15 Seconds | | | | |
| Coke at End of Guide | 10 | 30 | 15 | 10 | 20 |
| | 30 | 30 | 30 | 10 | 10 |
| Completion of Push | 10 | 10 | 10 | 10 | 10 |
| | 0 | 10 | 10 | 10 | 0 |
| | 0 | 10 | 10 | 20 | 0 |
| | 0 | 10 | 10 | 20 | 0 |
| | 0 | 0 | 10 | 10 | 0 |
| | 0 | 0 | | | 0 |
| | 0 | 0 | | | 0 |
| | 0 | 0 | | | 10 |
| | 0 | | | | |
| Hood Removed | 0 | 20 | 10 | 10 | 0 |
| Car Traveling to Quench Station | 0 | 0 | 0 | 10 | 10 |
| | 0 | 10 | 0 | 10 | 5 |

TABLE 3-continued

Summary of Visible Emissions Observations for 22 Foot Prototype Quench Car and Open Coke Guide

| | | | | | |
|---|---|---|---|---|---|
| | 0 | 0 | 0 | 10 | 5 |
| | 0 | 0 | 0 | 5 | 5 |
| | 10 | 0 | 0 | 5 | 5 |
| | 0 | 0 | 0 | 5 | 5 |
| | 0 | 0 | 0 | 5 | 0 |
| | 0 | 0 | 0 | 0 | 0 |
| | 0 | 0 | | 0 | 0 |
| | 0 | 20 | | 0 | 0 |
| | 10 | 20 | | 0 | 0 |
| | 0 | 10 | | 0 | 10 |
| | 0 | 10 | | 10 | 0 |
| | 0 | | | 10 | 0 |
| | | | | 0 | 0 |
| | | | | | 0 |
| Car at Quench Station | 0 | 0 | 0 | 0 | 20 |

*Estimated

TABLE 3a

Summary of Visible Emissions Observations for 22 Foot Prototype Quench Car and Open Coke Guide

| Test No. | 6 | 7 | 8 | 9 | 10 |
|---|---|---|---|---|---|
| Coking Time (hr.:min.) | 14:42 | 14:30 | 14:35 | 14:29 | 14:49 |
| Exhaust Gas Flow (acfm) | 94,500 | 69,750 | 91,000 | 44,150 | 43,400 |
| Exhaust Gas Flow (scfmd) | 57,250 | 49,500 | 36,100 | 19,150 | 24,000 |
| Duct. Temp. (°F.) | 165 | 140 | 500 | 410 | 250 |
| Time Car Under Hood After Completion of Push (sec.) | 105 | 135 | 30 | 120 | 30 |
| Phase of Pushing Sequence | Opactiy Ratings Recorded Every 15 Seconds | | | | |
| Coke at End of Guide Completion of Push | 0 | 20 | 0 | 100 | 0 |
| | 0 | 0 | 20 | 100 | 10 |
| | 0 | 0 | 0 | | |
| | 0 | 0 | 0 | 100 | 0 |
| | 0 | 0 | | 0 | 0 |
| | 0 | 0 | | 0 | |
| | 0 | 0 | | 0 | |
| | 0 | 0 | | 0 | |
| | 0 | 0 | | 0 | |
| | | 0 | | 0 | |
| | | 0 | | 0 | |
| Hood Removed Car Traveling to Quench Station | 0 | 10 | 0 | 20 | 10 |
| | 10 | 10 | 20 | 20 | 10 |
| | 10 | 5 | 10 | 20 | 10 |
| | 0 | 5 | 10 | 10 | 10 |
| | 0 | 5 | 10 | 5 | 5 |
| | 0 | 0 | 10 | 10 | 10 |
| | 0 | 0 | 5 | 5 | 0 |
| | 0 | 0 | 5 | 5 | 0 |
| | 0 | 0 | 0 | 0 | 0 |
| | 0 | 0 | 5 | 5 | 0 |
| | 0 | 0 | 0 | 10 | |
| | 0 | 0 | | 5 | |
| | 0 | | | | |
| | 0 | | | | |
| | 0 | | | | |
| Car Under Quench Station | 0 | 0 | 0 | 0 | 5 |

TABLE 3b

Summary of Visible Emmissions Observations for 22 Foot Prototype Quench Car and Open Coke Guide

| Test No. | 11 | 12 | 13 | 14 | 15 |
|---|---|---|---|---|---|
| Coking Time (hr.:min.) | 14:30 | 15:52 | 14:33 | 14:35 | 14:55 |
| Exhaust Gas Flow (acfm) | 36,500 | 18,900 | 69,400 | 70,800 | 94,300 |

TABLE 3b-continued

Summary of Visible Emmissions Observations for 22 Foot Prototype Quench Car and Open Coke Guide

| | | | | | |
|---|---|---|---|---|---|
| Exhaust Gas Flow (scfmd) | 16,200 | 9,900 | 54,750 | 40,400 | 54,100 |
| Duct Temp. (°F.) | 450 | 350 | 150 | 210 | 160 |
| Time Car Under Hood After Completion of Push (sec.) | 90 | 90 | 75 | 30 | 90 |
| Phase of Pushing Sequence | Opacity Ratings Recorded Every 15 Seconds | | | | |
| Coke at End of Guide Completion of Push | 100 | 100 | 20 | 0 | 0 |
| | 40 | 100 | 10 | 40 | 0 |
| | 0 | 5 | 0 | 0 | 0 |
| | 20 | 5 | 0 | 30 | 0 |
| | 0 | 0 | 5 | | 0 |
| | 10 | 0 | 0 | | 0 |
| | 0 | 0 | 0 | | 0 |
| | 0 | 0 | | | 0 |
| Hood Removed Car Traveling to Quench Station | 0 | 10 | 0 | 50 | 0 |
| | 20 | 0 | 0 | 50 | 50 |
| | 10 | 5 | 10 | 50 | 40 |
| | 10 | 5 | 10 | 30 | 30 |
| | 10 | 5 | 5 | 20 | 10 |
| | 10 | 5 | 10 | 20 | 5 |
| | 0 | 0 | 5 | 10 | 5 |
| | 0 | 0 | 5 | 10 | 5 |
| | 0 | 0 | 5 | 0 | 5 |
| | 30 | | 5 | | 5 |
| | 0 | | 0 | | 5 |
| | | | | | 5 |
| | | | | | 5 |
| | | | | | 0 |
| Car Under Quench Station | 0 | 0 | 0 | 0 | 5 |

TABLE 3c

Summary of Visible Emmissions Observations for 22 Foot Prototype Quench Car and Open Coke Guide

| Test No. | 16 | 17 | 18 | 19 | 20 |
|---|---|---|---|---|---|
| Coking Time (hr.:min.) | 14:59 | 14:35 | 14:38 | 14:27 | 14:27 |
| Exhaust Gas Flow (acfm) | 75,600 | 65,600 | 94,300* | 94,300* | 94,300* |
| Exhaust Gas Flow (scfmd) | 48,600 | 37,200 | ** | ** | ** |
| Duct Temp. (°F.) | 150 | 215 | ** | ** | ** |
| Time Car Under Hood After Completion of Push (sec.) | 75 | 75 | 60 | 75 | 75 |
| Phase of Pushing Sequence | Opacity Ratings Recorded Every 15 Seconds | | | | |
| Coke at End of Guide Completion of Push | 10 | 40 | 0 | 0 | 20 |
| | 40 | 60 | 20 | 40 | 20 |
| | 0 | 80 | 0 | 0 | 10 |
| | 0 | 100 | 0 | 0 | 0 |
| | 0 | 0 | 0 | 0 | 0 |
| | 0 | 0 | 0 | 0 | 0 |
| | 0 | 0 | | 0 | 0 |
| Hood Removed Car Traveling to Quench Station | 0 | 80 | 10 | 20 | 20 |
| | 10 | 80 | 0 | 0 | 25 |
| | 20 | 80 | 10 | 0 | 20 |
| | 20 | 40 | 10 | 5 | 20 |
| | 20 | 30 | 5 | 0 | 20 |
| | 10 | 30 | 5 | 0 | 20 |
| | 10 | 30 | 5 | 0 | 20 |
| | 10 | 20 | 0 | 0 | 10 |
| | 10 | 20 | 5 | 0 | 10 |
| | 10 | 10 | 5 | 0 | 10 |
| | 30 | 10 | 10 | 0 | 10 |
| | 10 | 10 | 5 | 0 | 10 |
| | | | | 0 | 0 |
| | | | | | 0 |
| | | | | | 0 |

TABLE 3c-continued

Summary of Visible Emmissions Observations for 22 Foot Prototype Quench Car and Open Coke Guide

| | | | | | |
|---|---|---|---|---|---|
| Car Under Quench Station | 10 | 5 | 5 | 0 | 0 |

*Estimated
**Not Obtained

TABLE 3d

Summary of Visible Emmissions Observations for 22 Foot Prototype Quench Car and Open Coke Guide

| Test No. | 21 | 22 |
|---|---|---|
| Coking Time (hr.:min.) | 14:42 | 14:31 |
| Gas Flowrate (acfm) | 94,300* | 72,600 |
| Gas Flowrate (scfmd) | ** | 22,900 |
| Duct Temp. (°F.) | ** | 450 |
| Time Car Under Hood After Completion of Push (Sec.) | 75 | ** |
| Phase of Pushing Sequence | Opacity Ratings Recorded Every 15 Seconds | |
| Coke at End of Guide | 0 | ** |
| | 0 | |

TABLE 3d-continued

Summary of Visible Emmissions Observations for 22 Foot Prototype Quench Car and Open Coke Guide

| | | |
|---|---|---|
| Completion of Push | 0 | ** |
| | 0 | |
| | 0 | |
| | 0 | |
| | 0 | |
| Hood Removed | 0 | ** |
| Car Traveling to Quench Station | 0 | ** |
| | 0 | |
| | 0 | |
| | 0 | |
| | 0 | |
| | 0 | |
| | 0 | |
| | 0 | |
| | 0 | |
| | 0 | |
| | 0 | |
| | 0 | |
| | 0 | |
| | 0 | |
| Car Under Quench Station | 0 | ** |

*Estimated
**Not Obtained - No Observer

TABLE 4

One-Spot Emission Control Tests
Gas Analysis For 22' Prototype Car

| Test No. | 1 | 2 | 3 | 4 | 5 |
|---|---|---|---|---|---|
| Coking Time (Hr.:min.) | 18:15 | 18:3 | 18:9 | 19:45 | 15:58 |
| Coking Quality | Clean | Clean | Very Green | Moderate | Moderate |
| Exhaust Gas Flowrate(scfmd) | 33,300 | 26,000 | 31,700 | 64,800 | 83,600 |

Gas Analysis

| | | | | | | | | | |
|---|---|---|---|---|---|---|---|---|---|
| Time Taken (Secs) | 10 | 20 | 15 | 25 | 15 | 25 | 20 | 15 | 25 |
| % CO | .35 | .08 | .51 | NA | .54 | NA | .21 | ND | .13 |
| % $H_2$ | NA | | NA | | NA | | NA | | NA |
| % $O_2$ | 18.06 | 13.40 | 10.28 | NA | 13.55 | NA | 13.54 | 13.98 | 13.90 |

Notes for Tables 4–4c:
1 - Test No. refers to test number recorded in Tables 2–2d
2 - Gas analysis samples were taken in the emissions collection main adjacent the oven being pushed
3 - ND means "not detected"
4 - NA means "not analyzed"
5 - Time Taken (secs) was duration of sampling starting when coke showed in the guide
6 - Gas Analysis results are in Mol %

TABLE 4a

One-Spot Emission Control Tests
Gas Analysis For 22' Prototype Car

| Test No | 6 | 7 | 8 | 9 | 10 |
|---|---|---|---|---|---|
| Coking Time (hr.:min.) | 14:42 | 14:30 | 14:35 | 14:29 | 14:49 |
| Coking Quality | Green | Green | Green | Very Green | Green |
| Exhaust Gas Flowrate (Scfmd) | 57,250 | 49,500 | 36,100 | 19,150 | 24,000 |

Gas Analysis

| | | | | | | | | | |
|---|---|---|---|---|---|---|---|---|---|
| Time Taken (Secs) | 15 | 25 | 15 | 25 | 15 | 25 | 20 | 15 | 25 |
| % CO | ND | ND | .27 | .64 | ND | ND | ND | .22 | .24 |
| % $H_2$ | .03 | ND | <.01 | <.01 | .03 | .03 | .12 | .23 | ND |
| % $O_2$ | 10.72 | 11.81 | 19.10 | 11.41 | 9.13 | 6.73 | 7.75 | 6.68 | 8.54 |

TABLE 4b

One-Spot Emission Control Tests
Gas Analysis For 22' Prototype Car

| Test No. | 11 | 12 | 13 | 14 | 15 |
|---|---|---|---|---|---|
| Coking Time (hr.:min.) | 14:30 | 15:52 | 14:33 | 14:35 | 14:55 |

TABLE 4b-continued

| Coking Quality | Green | | Clean | | Green | | Green | | Green | |
|---|---|---|---|---|---|---|---|---|---|---|
| Exhaust Gas Flowrate(scfmd) | 16,200 | | 9,900 | | 54,750 | | 40,400 | | 54,100 | |
| Gas Analysis | | | | | | | | | | |
| Time Taken (Secs) | 15 | 25 | 15 | 25 | 15 | 25 | 15 | 25 | 15 | 25 |
| % CO | 2.05 | .53 | .32 | .53 | .30 | ND | .50 | ND | .19 | ND |
| % $H_2$ | 1.57 | .82 | .17 | .13 | .46 | .02 | ND | ND | .12 | ND |
| % $O_2$ | 3.61 | 6.00 | 8.61 | 7.36 | 7.28 | 9.83 | 10.03 | 10.90 | 10.51 | 12.73 |

TABLE 4c

One-Spot Emission Control Tests
Gas Analysis For 22' Prototype Car

| Test No. | 16 | | 17 | | 18 to 21 | 22 | |
|---|---|---|---|---|---|---|---|
| Coking Time (hr.:min.) | 14:59 | | 14:35 | | No Samples Taken | 14:31 | |
| Coking Quality | Green | | Very Green | | " | Very Green | |
| Exhaust Gas Flowrate(scfmd) | 48,600 | | 37,200 | | " | 22,870 | |
| Gas Analysis | | | | | | | |
| Time Taken (Secs) | 15 | 25 | 15 | 25 | No Samples Taken | 15 | 25 |
| % CO | ND | .38 | .40 | .39 | " | 2.58 | .60 |
| % $H_2$ | ND | ND | .24 | .16 | " | 2.96 | 1.31 |
| % $O_2$ | 15.15 | 13.56 | 7.17 | 12.23 | " | 2.38 | 4.26 |

In order to determine the opacity ratings listed in Table 1 and 3–3*d*, emission observations were made by E.P.A. certified visible emission observers. During the tests of the 22 foot receiver car, i.e. the "tight system", visible emissions observations were performed by one observer. This observer was located in the "south observer's position" 61 shown in FIG. 4. From that position, the observer recorded visible emissions emanating from the open coke guide and hood during each test push. Observations began when the coke appeared at the end of the coke guide. The observer recorded visible emissions emanating from the coke guide and hood during the push and while the hood was removed from the car. When quenching car 16 began to travel to the quench station, as shown in phantom, the observer followed the car on a parallel path about 50 feet east of the quench car tracks and continued to observe and record visible emissions every 15 seconds. Observations ended when the car was stopped under the quench station.

During the tests of the 30 foot receiver car, i.e. the "gap system", observations were made by two certified observers. One observer was initially located in the "south observer's position" 61 and the other was located in the "north observer's position" 62, FIG. 4. The south observer followed the same procedure as for the 22 foot receiver car tests and the north observer only observed and recorded visible emissions emanating from the north side of the coke guide and hood during each test push.

The times recorded in the Tables 1 and 3–3*d* inclusive opposite the heading "Time Car Under Hood After Completion of Push" does not include the time required to make the push.

The results of the tests numbered 1–22 inclusive with the "tight system" are recorded in Tables 3–3*d* inclusive and 4–4*c* inclusive. The exhaust gas flowrates varied from 9,900 standard cubic feet per minute dry (scfmd) to 83,600 standard cubic feet per minute dry (scfmd) and the coking times were varied from 14 hrs., 27 minutes, to 19 hrs., 45 minutes.

Upon completion of the "tight system" tests the quenching car was lengthened to 30 feet and the hood made the same length. Results of tests numbered 1–5 inclusive which were performed on this modified car, i.e., the "gap system", are recorded in Tables 1 and 2. For the "gap system" tests the exhaust gas flowrates varied from 62,500 standard cubic feet per minute dry (scfmd) to 82,250 standard cubic feet per minute dry (scfmd) and the coking time was varied from 14 hrs., 30 mins., to 15 hrs., 8 mins., respectively. Tests numbered 1–3 inclusive were performed with an interface gap 52, FIG. 3, between fume hood 15 and quenching car 16 of about 3 inches. Test 4 was performed with a 6" gap and test 5 with a 6" gap that was shrouded.

It was determined from the test data shown in Tables 3–3*d* inclusive that opacity ratings of 40 percent or below were attained in the tests having an exhaust gas flowrate between 24,000 scfmd (test #10) and 83,600 scfmd (test #5) and time under the hood after completion of the push from 30 secs. to 135 secs. None of the tests 1–22 were outside of this time range. It was concluded that less than 30 secs. would result in unacceptable emissions and more than 135 secs., would result in unnecessary loss of coke by combustion. Fifteen of the twenty-two tests had exhaust gas flowrates (scfmd) which fell within the range of 24,000 scfmd and 83,600 scfmd. Three tests were outside of this range and the remaining four tests, 18–21 inclusive, were not completed. Of the fifteen tests which were within the desired range, tests 14, 15 and 17 recorded opacity ratings greater than 40 percent. This was caused by coke being left in the guide after the push or green coke on top of the coke pile in the car during travel.

The range of gas temperatures taken at the inlet to the fan was from 132° F. (test #5) to 600° F. (test #3). These temperatures, which were controlled by gas cooling water, are considered well within a safe operating range. High gas temperatures, i.e. about 800° F. and above, would damage the equipment, especially the fan.

Referring to the test data in Table 1 it is noted that opacity ratings of 40 percent or below were attained in tests 1–5 for all of the observations except test 4. The unacceptable opacity ratings recorded under test 4 are attributed to the fact that the emissions from the 6" gap between the hood and the car could not be controlled without flowrates higher than the fan could produce. Exhaust gas flowrate must increase as the gap between the fume hood and car increases so that a negative pressure is maintained in the hood. The negative pressure must be great enough to overcome momentary puffs or bursts of gases which result during a coke push. If the negative pressure is insufficient, emissions to the atmosphere through the gap or other open areas will result. Thus, the 6" gap used in test #4 was shrouded for test #5 to reduce the gap size. The shrouding created a barrier to minimize air currents and hence acceptable opacity ratings were obtained for test #5. Tests 1–5, Table 1 all came within the desired exhaust gas flowrate (scfmd) of 24,000 to 83,600 and the range of time for the car under the hood after completion of the push of 30–135 secs. The fan duct temperature ranged from 155° F–170° F. well within the operating range of the tests of Tables 3–3*d* inclusive. Referring to Tables 4–4*c* inclusive and Table 2, it has been found for the test made that 24,000 scfmd is the flowrate of exhaust gas below which significant concentrations of combustible gases were found in the exhaust gas. This figure was determined by examining the exhaust gas analyses for the combustible constituents, i.e. carbon monoxide, CO, and hydrogen, $H_2$, and for oxygen, $O_2$. Although all the tests showed some excess $O_2$, tests #11 and #22, Tables 4*b* and 4*c* respectively, showed significant concentrations of CO and $H_2$, i.e. greater than 1.00% CO or 0.5% $H_2$. Tests #11 and #22 were at gas flowrates less than 24,000 scfmd, e.g. test #11 was at 16,200 scfmd and test #22 was at 22,870 scfmd. Test #3, Table 4, having similar coking conditions showed no significant $H_2$ or CO at 31,700 scfmd. Therefore, 24,000 scfmd was established as the critical (minimum) exhaust gas flowrate. The volume of control air for good control of emissions generated during pushing of a coke oven must be sufficient: (a) for combustion of the volatile matter and other combustibles emitted from the coke, (b) to insure that the incomplete combustion products are at a concentration below the explosive limit, (c) to prevent overheating of the system and (d) to accommodate surges or puffs of gas that may occur as the coke crumbles and falls into the car, whereby the quenching car can travel from the oven to a quenching station without the hot coke giving off emissions in excess of 40% opacity.

Referring to tests No. 6, 7, 13, 15, 16 and observations and examination of the data in the field, it was concluded that about 52,000 scfmd was needed to control emissions with the tight system. Since fans are not rated in scfmd but rather acfm frequently saturated with water at a given temperature, it had to be determined what that saturation temperature would be.

Early in the testing, it was concluded that test #6 appeared to represent good control. The only control over saturation temperature was to adjust the inlet fan damper and to try to adjust the gas cooling water to provide gas saturated with water vapor. It was concluded that a fan damper setting No. 7 provided optimum adjustment. Tests 7, 13, 15 and 16 were run at damper setting 7— average saturated gas temperature of these tests is 150° F. and average flow is 52,000 scfmd.

For the gap tests, good control of emissions with a 3" gap or a shrouded 6" gap at 110,000 acfm which was the maximum fan capacity was observed. The temperature averaged 155° F. so—

110,000×530/615×0.715=68,000 scfmd

530=degrees Rankine (70° F. Standard+460)

615=degrees Rankine (155° F.+460)

0.715=cubic feet of dry gas per cubic feet of saturated gas at 155° F.

Thus, the optimum exhaust gas flowrates were established as 52,000 scfmd for the "tight system" FIG. 2 and 68,000 scfmd for the "gap system" FIG. 3.

During all these tests, 23.5 tons of coke were pushed from each oven in 35seconds. Therefore the exhaust rate per ton of coke during the push is:

$$\text{"Tight" System: } \frac{52{,}000\ scfmd}{23.5\ T} = 2{,}200\ scfmd/T$$

$$\text{"Gap" System: } \frac{68{,}000\ scfmd}{23.5\ T} = 2{,}900\ scfmd/T$$

Since the 23.5 T coke was pushed in 35 seconds, the gas flowrate per ton of coke pushed per minute is:

$$\frac{35}{60}\ \text{min} \times 2{,}200\ scfmd/T = 1{,}300\ scfmd/\text{Tons of coke pushed/min. ("tight system")}$$

$$\frac{35}{60}\ \text{min} \times 2{,}900\ scfmd/T = 1{,}700\ scfmd/\text{Tons of coke pushed/min. ("gap system")}$$

Similar calculations were made with respect to the 24,000 scfmd to 83,600 scfmd range applicable to the "tight system", FIG. 2, and the "gap system", FIG. 3, referred to hereinbefore and for convenience the exhaust gas flowrates (scfmd) are tabulated below in Table 5.

TABLE 5

| Parameter | | Exhaust Gas Tight System | Exhaust Gas Gap System |
|---|---|---|---|
| Gas Flowrate scfmd | Broad Range | 24,000–83,600 | 24,000–83,600 |
| Gas Flowrate scfmd | Narrow Range | 24,000–52,000 | 24,000–68,000 |
| Gas Flowrate scfmd | Optimum | 52,000 | 68,000 |
| Gas Flowrate per Ton of Coke scfmd/Ton | Broad Range | 1,000–3,500 | 1,000–3,500 |
| Gas Flowrate per Ton of Coke scfmd/Ton | Narrow Range | 1,000–2,200 | 1,000–2,900 |
| Gas Flowrate per Ton of a Coke scfmd/Ton | Optimum | 2,200 | 2,900 |
| Gas Flowrate/ Ton of Coke/Min. | Broad Range | 600–2,100 | 600–2,100 |
| Gas Flowrate Ton of Coke/Min. | Narrow Range | 600–1,300 | 600–1,700 |
| Gas Flowrate Ton of Coke/Min. | Optimum | 1,300 | 1,700 |

While the method of practicing this invention has been described with respect to an open-top, one-spot quenching car, it should be recognized that the invention can be practiced with alternate forms of apparatus. For example, in FIGS. 7 and 9 there is shown a one-spot quenching car 116 having a lower portion 117 and an upper portion or cover 118. On the battery side of lower portion 117, adjacent its center, is an opening 148 at an elevation just below that of the bottom of the coke guide, hereinafter described. Car upper portion 118 has side plate 119 adjacent to the battery, closed ends 120 and 121, closed top 122 and side 123, which is on the opposite side of the car to that of side 119. Side 119 has a large opening 124 through which hot coke is pushed into the quenching car and through which water is sprayed into the car at the quenching station to cool the hot coke. Side 123 has, adjacent to its center and top, a duct connection 151. Connection 151 abuts with gas-exhaust cleaning equipment, not shown, including duct work, collecting main, gas cleaning equipment and fan, which, as is well known to one skilled in the art, is similar to the equipment described in conjunction with the open top, one-spot quenching car previously described.

Quenching car 116 operates in cooperation with coke guide 14' that is supported on coke guide car 29' and has bottom 30', top 31', transition section 32' and opening 47' in the manner of the coke guide previously described. At the end of coke guide 14' spaced from the ovens are wing plates 145 and 146 that extend vertically outwardly from the guide parallel to the ends of the coke side of ovens 11. Wing plates 145 and 146 are sized to extend beyond ends 120 and 121 and above top 122 of upper portion 117 of quenching car 116. When coke quenching car 116 is in alignment with coke guide 14' to receive hot coke discharged from an oven, wing plates 145 and 146 are spaced, with minimum permissible clearance, a short distance from side 119 of upper portion 118 of coke quenching car 116.

To practice the method of this invention with ones-pot quenching car 116, the car is positioned so that duct connection 151 is in alignment with gas exhaust cleaning equipment, not shown, but similar to that shown in FIGS. 1–4 and described previously. The center of opening 124 of upper portion 118 of quenching car 116 is in alignment with opening 47' of coke guide 14'. Coke guide opening 47' is in alignment with an oven 11 from which the doors have been removed preparatory to discharge of the coke mass 60 from the oven. Coke guide transition section 32' is in position against coke side oven end 27.

The gas exhaust cleaning system is activated and the discharge of coke mass 60 from an oven chamber 25 is started. The movement of the pusher ram, not shown, forces the coke mass 60 from chamber 25 through coke guide transition section 32' and coke guide 14'. At the end of the guide 14' farthest from oven end 27 the coke is no longer supported by guide bottom 30' and crumbles and falls through opening 124 of upper portion 118 into lower portion 117 of quenching car 116 until the entire mass of coke from the open chamber 25 is deposited in car 116.

While the coke is pushed from oven chamber 25, the gas exhaust cleaning system causes air to be drawn through (a) chamber passageway 55 in the top of chamber 25, between the top of the coke mass 60 and the over top 26 and connecting guide passageway 56' in the top of coke guide 14', between the top of the coke mass 60 and the coke guide top 31' and into the upper portion 118 of quenching car 116; (b) through the gap that exists between wing plates 145–146 and upper portion side plate 118; and (c) opening 148 in lower portion 117 of quenching car 116 and into upper portion 118. The air drawn into upper portion 118 mixes with the emissions resulting from the discharge of coke into the quenching car 116, and the air and emissions are exhausted from upper portion 118 through connection 151 and into the gas exhaust-cleaning system. The withdrawal of air and emissions is continued until the push is complete and for a dedusting period after the completion of the push. Thereafter car 116 with its load of hot coke is moved to quenching station 19 with the hot coke exposed to the atmosphere through openings 124 and 151 in upper portion 118 and opening 148 is lower portion 117 of coke car 116. During the movement of quenching car 116 to the quenching station emissions given off by the hot coke are less than 40% opacity.

Figure 7:
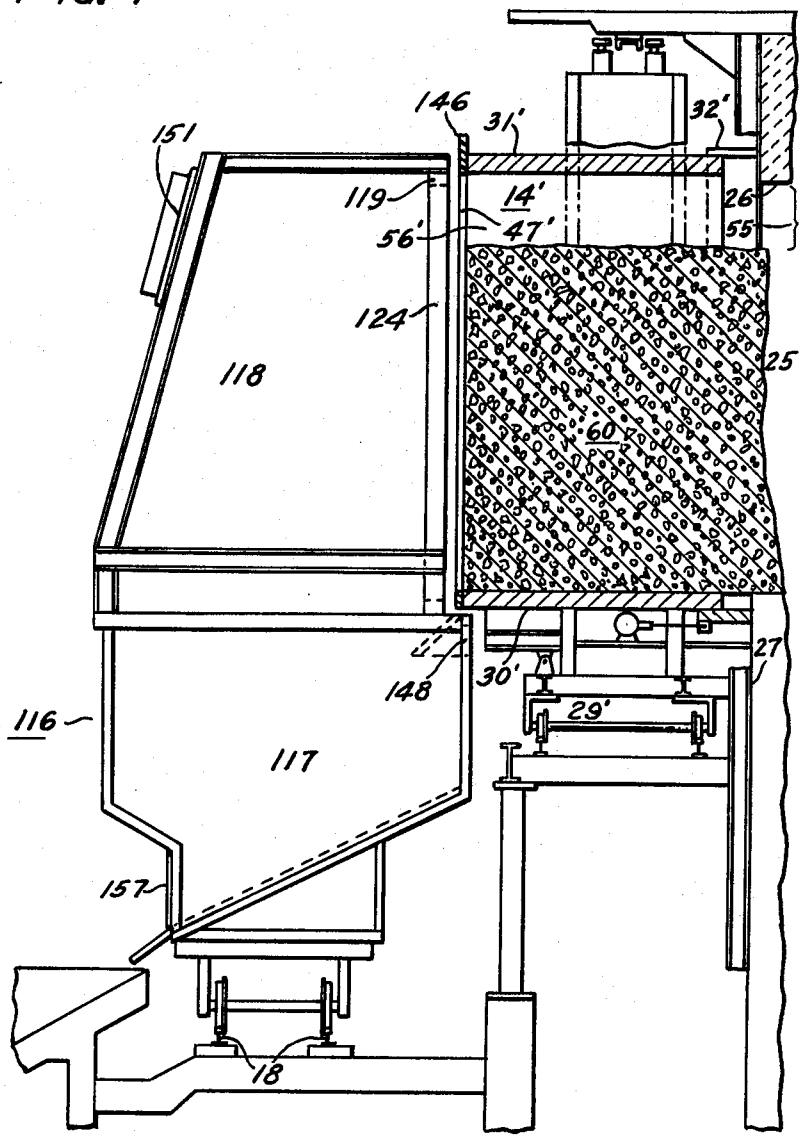
FIG. 7 is a view similar to FIG. 2 showing an alternate form of apparatus on which the instant invention can be practiced.
Figure 8:
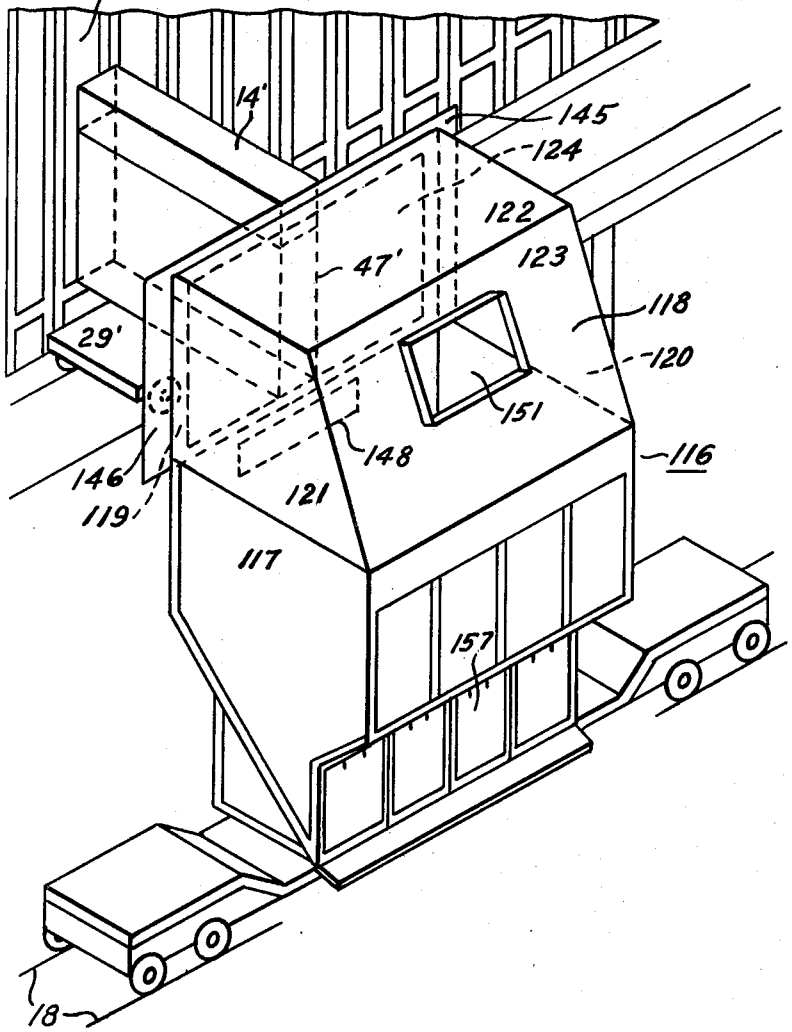
FIG. 8 is an isometric schematic view of the apparatus of FIG. 7.
Figure 9:
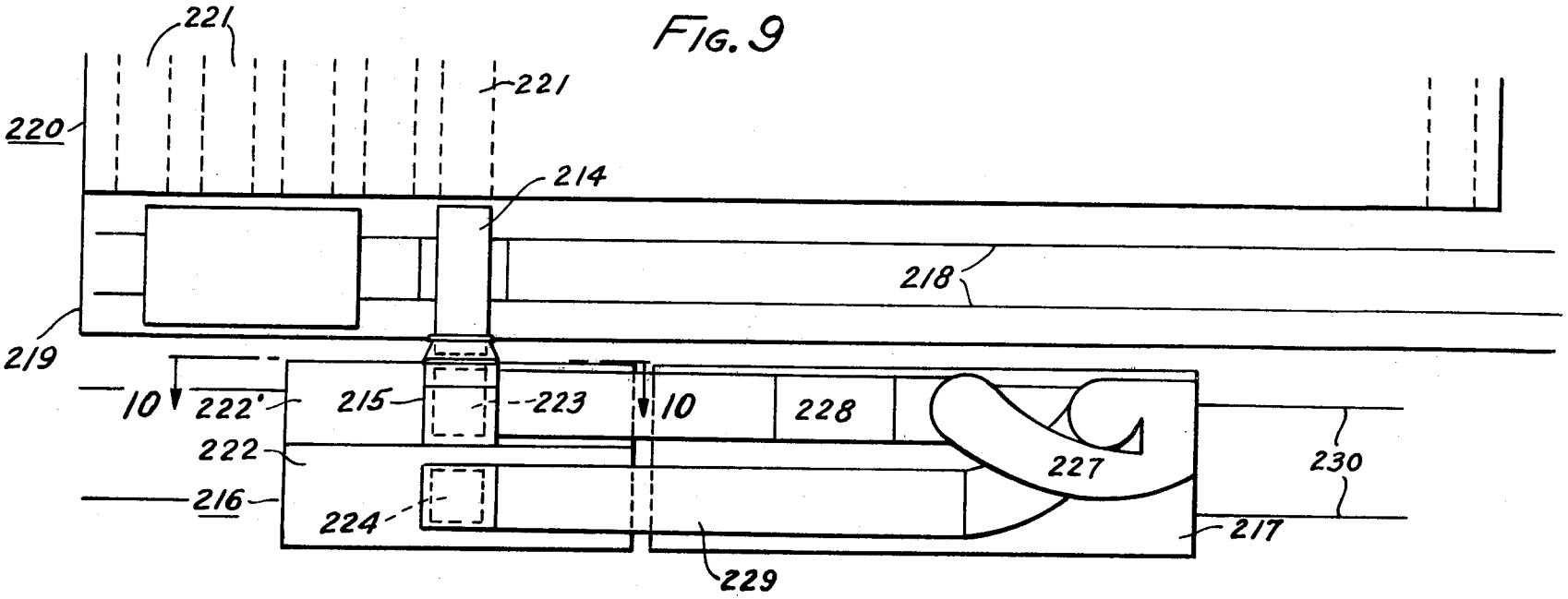
FIG. 9 is a block diagram showing still another alternate form of apparatus on which the instant invention can be practiced.
Figure 10:
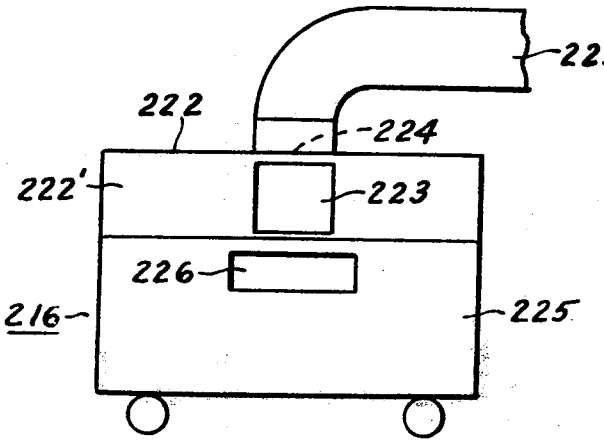
FIG. 10 is an elevation taken on line 10—10 of FIG. 9.

In addition to the alternate form of apparatus shown in FIGS. 7 and 8 that can be used to practice this invention, it may also be practiced with a "mobile" system similar to that shown in FIGS. 9 and 10, and which is well known to one skilled in the art. Briefly described, the system comprises coke guide 214 and, operating in tandem, coke quenching car 216 and gas-exhaust cleaning car 217. Coke guide 214 has a retractable hood 215 and runs on tracks 218 that extend along the length of coke side bench 219 of coke oven battery 220 that consists of a plurality of ovens 221. Coke quenching car 216 has top cover 222 having a sloped portion 222' that has opening 223 through which coke falls into car 216 and opening 224 through which air and emissions pass from car 216. Opening 223 is adjacent to coke side bench 219 while opening 224 is on the opposite side of top cover 22 from opening 223. Both openings 223 and 224 are located about the center of cover 222. Coke quenching car 216, has, closest to battery 220, side 225 that has, adjacent its center and top, air opening 226 through which air is drawn into car 216. Gas exhaust-cleaning car 217 includes gas exhaust-cleaning system 227 and operator's cab 228. Duct 229 connects at one end with opening 224 of top cover 222 of car 216 and at the other end with gas exhaust-cleaning system 227 of car 217. The tandem operating coke quenching car 216 and gas exhaust-cleaning car 217 operate on tracks 230 at ground level that lead to a quenching station, not shown.

To practice the method of this invention with the above described "mobile" system, coke guide 214 is aligned with an oven 221 from which coke is to be pushed, and coke quenching car 216 is moved alongside coke guide 214. Retractable hood 215 is lowered over opening 223 in the sloped portion 222' of top cover 222 of quenching car 216. The gas exhaust-cleaning sytem 227 is activated and air is drawn into the covered coke quenching car 216 through coke guide 214, retractable hood 215 and air opening 226 of coke quenching car side 225, as well as through any of the spaces existing between the above mentioned equipment. The air is exhausted from coke quenching car 216 through duct 229 and through gas exhaust-cleaning system 227 to the atmosphere. During the discharge of coke from oven 221 and for a dedusting period thereafter, the gas exhaust-cleaning system 227 is operated to draw air into car 216 where it mixes with the emissions resulting from the discharge of hot coke into car 216. The air and emissions are drawn from car 216 through opening 224 and duct 229, through gas exhaust-cleaning system 227 and, after cleaning, exhausted to the atmosphere. After completion of the push and the dedusting period coke guide retractable hood 215 is raised and the tandem operating coke quenching car 216 and gas exhaust-cleaning car 217 move on tracks 230 to the quenching station. During movement of the cars, the hot coke in car 216 is exposed to the atmosphere through opening 223 in sloped portion 22' of top 222 and through air opening 226 in side 225 of quenching car 216. For a variety of reasons, it may be desirable to maintain the gas exhaust-cleaning system 227 of gas exhaust-cleaning car 217 in operation while quenching car 216 and gas exhaust-cleaning car 217 are moving in tandem to the quenching station. Under the circumstances, with a "mobile" system at the end of the dedusting period, the withdrawal of gases from quenching car 216 on its travel to the quenching station can either cease or be reduced to a rate such that a net gas flow is out of the car to the atmosphere and during such travel the visible emissions given off by the hot coke are less than 40% opacity. By "net gas flow" we mean that condition where the rate of exhaust of the gases in volume per unit of time from the car by a gas moving device, e.g. a fan which is installed to control emissions from the hot coke mass, is less than the rate of gas generation in volume per unit of time from the hot coke mass. Thus, there is a flow of gases out of the car to the atmosphere.

While there has been described and illustrated various forms of equipment with which several embodiments of the invention may be practiced, it will be apparent to those skilled in the art that various other forms of equipment and modifications may be made without departing from the spirit of the invention or the scope of the appended claims.

We claim:

1. A method for controlling coke oven emissions comprising the steps of:

(a) aligning a one-spot, open-top coke quenching car with the coke oven, (b) providing a coke guide from the coke oven to the car, (c) positioning a fume hood over the car, with the fume hood having a length about equal to the length of the car, (d) pushing hot coke from the coke oven through the coke guide and into the car, (e) withdrawing gases from the fume hood during step (d) and passing said gases to gas cleaning equipment at a gas flowrate of between about 1000 and about 3500 scfmd per ton of coke pushed under step (d), and (f) substantially upon completion of step (e) moving the car from under the fume hood to a quenching station with the hot coke in the car exposed to the atmosphere and without further withdrawal of gases from the hot coke to the gas cleaning equipment.

2. Method according to claim 1 wherein the time for withdrawing gases under step (e) continues for a period of time of between about 30 seconds and about 135 seconds after the completion of step (d).

3. Method according to claim 1 wherein the opacity of the emissions from the car during step (f) does not exceed an opacity rating of 40 percent.

4. Method according to claim 1 wherein the size of the coke oven is about 6 meters.

5. Method according to claim 4 wherein the time for withdrawing gases under step (e) continues for a period of time between about 30 seconds and about 135 seconds after the completion of step (d) and the opacity of the emissions from the car during step (f) does not exceed an opacity rating of 40 percent.

6. Method according to claim 1 wherein the gas flowrate under step (e) is between about 600 and about 2100 scfmd per ton of coke pushed per minute under step (d).

7. Method according to claims 6, 8 or 9 wherein the time for withdrawing gases under step (e) continues for a period of time between about 30 seconds and about 135 seconds after the completion of step (d).

8. Method according to claim 6 wherein the opacity of the emissions from the car during step (f) does not exceed an opacity rating of 40 percent.

9. Method according to claim 8 wherein the size of the coke oven is about 6 meters.

10. A method for controlling coke oven emissions comprising the steps of:

(a) aligning a one-spot, open-top coke quenching car with the coke oven, (b) providing a coke guide from the coke oven to the car, (c) fitting a fume hood in substantial sealing engagement with the end of the coke guide and the car, (d) pushing hot coke from the coke oven through the coke guide and into the car, (e) withdrawing gases from the fume hood during step (d) and passing said gases to gas cleaning equipment at a gas flowrate of between about 1000 and about 3500 scfmd per ton of coke pushed under step (d), (f) removing the fume hood from the car, and (g) substantially upon completion of step (e) moving the car to a quenching station with the hot coke in the car exposed to the atmosphere and without further withdrawal of gases from the hot coke to the gas cleaning equipment.

11. The method according to claim 10 wherein the time for withdrawing gases under step (e) continues for a period of time of between about 30 seconds and about 135 seconds after completion of step (d).

12. The method according to claim 10 wherein the opacity of the emissions from the car during step (g) does not exceed an opacity rating of 40 percent.

13. The method according to claim 10 wherein the size of the oven is about 6 meters and the opacity of the emissions from the car during step (g) does not exceed an opacity rating of 40 percent.

14. The method according to claim 10 wherein the size of the coke oven is about 6 meters.

15. The method according to claim 14 wherein the time for withdrawing gases under step (e) continues for a period of time of between about 30 seconds and about 135 seconds after completion of step (d) and the opacity of the emissions from the car during step (g) does not exceed an opacity rating of 40 percent.

16. The method according to claim 10 wherein during step (e) air is drawn into the fume hood through a first opening between the top of the coke in the coke guide and the top of the coke guide and a second opening in the side of the fume hood adjacent the coke oven and about at an elevation equal to the elevation of the bottom of the coke guide.

17. The method according to claim 16 wherein the first opening is about 3 square feet and the second opening is about 6 square feet.

18. The method according to claim 16 wherein the size of the oven is about 6 meters and the opacity of the emissions from the car during step (g) does not exceed an opacity rating of 40 percent.

19. The method according to claim 10 wherein the gas flowrate under step (e) is between about 1000 to about 2200 scfmd per ton of coke pushed under step (d).

20. Method according to claims 13, 17, wherein the time for withdrawing gases under step (e) continues for a period of time between about 30 seconds and about 135 seconds after the completion of step (d).

21. The method according to claim 19 wherein during step (e) air is drawn into the fume hood through a first opening between the top of the coke in the coke guide and the top of the coke guide and a second opening in the side of the fume hood adjacent the coke oven and about at an elevation equal to the elevation of the bottom of the coke guide.

22. The method according to claim 21 wherein the first opening is about 3 square feet and the second opening is about 6 square feet.

23. The method according to claim 21 wherein the size of the coke oven is about 6 meters.

24. The method according to claim 21 wherein the opacity of the emissions from the car during step (g) does not exceed an opacity rating of 40 percent.

25. The method according to claim 10 wherein the gas flowrate under step (e) is between about 600 and about 1300 scfmd per ton of coke pushed per minute under step (d).

26. The method according to claim 25 wherein during step (e) air is drawn into the fume hood through a first opening between the top of the coke in the coke guide and the top of the coke guide and a second opening in the side of the fume hood adjacent the coke oven and about at an elevation equal to the elevation of the bottom of the coke guide.

27. The method according to claim 26 wherein the first opening is about 3 square feet and the second opening is about 6 square feet.

28. The method according to claim 26 wherein the size of the coke oven is about 6 meters.

29. The method according to claim 26 wherein the opacity of the emissions from the car during step (g) does not exceed an opacity rating of 40 percent.

30. The method according to claim 10 wherein the gas flowrate under step (e) is equal to about 2200 scfmd per ton of coke pushed under step (d).

31. The method according to claim 30 wherein during step (e) air is drawn into the fume hood through a first opening between the top of the coke in the coke guide and the top of the coke guide and a second opening in the side of the fume hood adjacent the coke oven and about at an elevation equal to the elevation of the bottom of the coke guide.

32. The method according to claim 31 wherein the first opening is about 3 square feet and the second opening is about 6 square feet.

33. The method according to claim 31 wherein the size of the coke oven is about 6 meters.

34. The method according to claim 31 wherein the opacity of the emissions from the car during step (g) does not exceed an opacity rating of 40 percent.

35. The method according to claim 10 wherein the gas flowrate under step (e) is equal to about 1300 scfmd per ton of coke pushed per minute under step (d).

36. The method according to claim 35 wherein the opacity of the emissions from the car during step (g) does not exceed an opacity rating of 40 percent.

37. The method according to claim 36 wherein during step (e) air is drawn into the fume hood through a first opening between the top of the coke in the coke guide and the top of the coke guide and a second opening in the side of the fume hood adjacent the coke oven and about at an elevation equal to the elevation of the bottom of the coke guide.

38. The method according to claim 37 wherein the first opening is about 3 square feet and the second opening is about 6 square feet.

39. The method according to claim 37 wherein the size of the coke oven is about 6 meters.

40. A method for controlling coke oven emissions comprising the steps of:

(a) aligning a one-spot, open-top coke quenching car with a coke oven, (b) providing a coke guide from the coke oven to the car, (c) enclosing the coke guide with a fume hood which extends over the top of the car and has a length about equal to the length of the car, (d) pushing hot coke from the coke oven through the coke guide and into the car, (e) withdrawing gases from the fume hood during step (d) and passing said gases to gas cleaning equipment at a gas flowrate of between about 1000 and about 3500 scfmd per ton of coke pushed under step (d), and (f) substantially upon completion of step (e) moving the car from under the fume hood to a quench station with the hot coke in the car exposed to the atmosphere and without further withdrawal of gases from the hot coke to the gas cleaning equipment.

41. The method of claim 40 wherein the time for withdrawing gases under step (e) continues for a period of time between about 30 seconds and about 135 seconds after completion of step (d).

42. The method according to claim 41 wherein the opacity of the emissions from the car during step (f) does not exceed an opacity rating of 40 percent.

43. The method according to claim 40 wherein the size of the oven is about 6 meters and the opacity of the emissions from the car during step (f) does not exceed an opacity rating of 40 percent.

44. The method of claim 40 wherein the size of the coke oven is about 6 meters.

45. The method according to claim 44 wherein the time for withdrawing gases under step (e) continues for a period of time of between about 30 seconds and 135 seconds after completion of step (d) and the opacity of the emissions from the car during step (f) does not exceed an opacity rating of 40 percent.

46. The method according to claim 40 wherein during step (e) air is drawn into the fume hood through a first opening between the top of the coke in the coke guide and the top of the coke guide, a second opening in the side of the fume hood adjacent the coke oven and about at an elevation equal to the elevation of the bottom of the coke guide, and a third opening between the top of the car and the bottom of the fume hood.

47. The method according to claim 46 wherein the first opening is about 3 square feet, the second opening is about 6 square feet and the third opening is about 22 square feet.

48. The method according to claim 46 wherein the size of the coke oven is about 6 meters.

49. The method according to claim 46 wherein the size of the coke oven is about 6 meters and the opacity of the emissions from the car during step (f) does not exceed an opacity rating of 40 percent.

50. The method according to claim 40 wherein the gas flowrate under step (e) is between about 1000 to about 2900 scfmd per ton of coke pushed under step (d).

51. Method according to claim 50, wherein the time for withdrawing gases under step (e) continues for a period of time between about 30 seconds and about 135 seconds after the completion of step (d).

52. The method according to claim 50 wherein during step (e) air is drawn into the fume hood through a first opening between the top of the coke in the coke guide and the top of the coke guide, a second opening in the side of the fume hood adjacent the coke oven and about at an elevation equal to the elevation of the bottom of the coke guide, and a third opening between the top of the car and the bottom of the fume hood.

53. The method according to claim 52 wherein the first opening is about 3 square feet, the second opening is about 6 square feet and the third opening is about 22 square feet.

54. The method according to claim 52 wherein the size of the coke oven is about 6 meters.

55. The method according to claim 52 wherein the opacity of the emissions from the car during step (f) does not exceed an opacity rating of 40 percent.

56. The method according to claim 40 wherein the gas flowrate under step (e) is between about 600 and about 1700 scfmd per ton of coke pushed per minute under step (d).

57. The method according to claim 56 wherein during step (e) air is drawn into the fume hood through a first opening between the top of the coke in the coke guide and the top of the coke guide, a second opening in the side of the fume hood adjacent the coke oven and about at an elevation equal to the elevation of the bottom of the coke guide, and a third opening between the top of the car and the bottom of the fume hood.

58. The method of claim 57 wherein the first opening is about 3 square feet, the second opening is about 6 square feet and the third opening is about 22 square feet.

59. The method according to claim 57 wherein the size of the coke oven is about 6 meters.

60. The method according to claim 57 wherein the opacity of the emissions from the car during step (f) does not exceed an opacity rating of 40 percent.

61. The method according to claim 40 wherein the gas flowrate under step (e) is equal to about 2900 scfmd per ton of coke pushed under step (d).

62. The method according to claim 61 wherein during step (e) air is drawn into the fume hood through a first opening between the top of the coke in the coke guide and the top of the coke guide, a second opening in the side of the fume hood adjacent the coke oven and about at an elevation equal to the elevation of the bottom of the coke guide, and a third opening between the top of the car and the bottom of the fume hood.

63. The method of claim 62 wherein the first opening is about 3 square feet, the second opening is about 6 square feet and the third opening is about 22 square feet.

64. The method according to claim 62 wherein the size of the coke oven is about 6 meters.

65. The method according to claim 63 wherein the opacity of the emissions from the car during step (f) does not exceed an opacity rating of 40 percent.

66. The method according to claim 40 wherein the gas flowrate under step (e) is equal to about 1700 scfmd per ton of coke pushed per minute under step (d).

67. The method according to claim 66 wherein the opacity of the emissions from the car during step (f) does not exceed an opacity rating of 40 percent.

68. The method according to claim 67 wherein during step (e) air is drawn into the fume hood through a first opening between the top of the coke in the coke guide and the top of the coke guide, a second opening in the side of the fume hood adjacent the coke oven and about at an elevation equal to the elevation of the bottom of the coke guide, and a third opening between the top of the car and the bottom of the fume hood.

69. The method of claim 68 wherein the first opening is about 3 square feet, the second opening is about 6 square feet and the third opening is about 22 square feet.

70. The method according to claim 68 wherein the size of the coke oven is about six meters.

71. A method of controlling coke oven emissions comprising the steps of:

(a) providing a one-spot, coke quenching car having an opening therein to receive hot coke from a coke oven, (b) aligning the opening of the car with a coke guide which extends from the coke oven to the car, (c) pushing hot coke from the coke oven and through the coke guide and the opening in the car, (d) withdrawing gases from the car during step (c) and passing said gases to gas cleaning equipment at a gas flowrate of between about 1000 and about 3500 scfmd per ton of coke pushed under step (c), and (e) substantially upon completion of step (d) moving the car to a quench station with the hot coke in the car exposed to the atmosphere through said opening while withdrawing gases at a rate within a range of zero to a rate at which the net flow of gases escapes through said opening out of the car to the atmosphere.

72. Method according to claim 71 wherein the size of the coke oven is about 6 meters.

73. Method according to claim 72 wherein the time for withdrawing gases under step (d) continues for a period of time of between about 30 seconds and about 135 seconds after the completion of step (c).

74. Method according to claim 71 wherein during step (d) air is drawn into the car through a first opening between the top of the coke in the coke guide and the top of the coke guide and a second opening in the side of the car adjacent the coke oven and about at an elevation equal to the elevation of the bottom of the coke guide.

75. Method according to claim 74 wherein the first opening is about 3 square feet and the second opening is about 6 square feet.

76. Method according to claim 74 wherein the oven size is about 6 meters.

77. Method according to claim 76 wherein the first opening is about 3 square feet and the second opening is about 6 square feet.

78. Method according to claim 71 wherein the time for withdrawing gases under step (d) continues for a period of time of between about 30 seconds and about 135 seconds after the completion of step (c).

79. Method according to claim 78 wherein during step (d) air is drawn into the car through a first opening between the top of the coke in the coke guide and the top of the coke guide and a second opening in the side of the car adjacent the coke oven and about at an elevation equal to the elevation of the bottom of the coke guide.

80. Method according to claim 79 wherein the first opening is about 3 square feet and the second opening is about 6 square feet.

81. Method according to claim 79 wherein the size of the coke oven is about 6 meters.

82. Method according to claim 81 wherein the first opening is about 3 square feet and the second opening is about 6 square feet.

83. Method according to claim 71 wherein the gas flowrate under step (d) is between about 600 and about 2100 scfmd per ton of coke pushed per minute.

84. Method according to claim 83 wherein the time for withdrawing gases under step (d) continues for a period of time of between about 30 seconds and about 135 seconds after the completion of step (c).

85. Method according to claim 84 wherein the size of the coke oven is about 6 meters.

86. Method according to claim 83 wherein during step (d) air is drawn into the car through a first opening between the top of the coke in the coke guide and the top of the coke guide and a second opening in the side of the car adjacent the coke oven and about at an elevation equal to the elevation of the bottom of the coke guide.

87. Method according to claim 86 wherein the first opening is about 3 square feet and the second opening is about 6 square feet.

88. Method according to claims 86, 87 or 89 wherein the time for withdrawing gases under step (d) continues for a period of time between about 30 seconds and about 135 seconds after the completion of step (d).

89. Method according to claim 86 wherein the size of the coke oven is about 6 meters.

90. Method according to claim 89 wherein the first opening is about 3 square feet and the second opening is about 6 square feet.

91. Method according to claim 90 wherein the time for withdrawing gases under step (d) continues for a period of time of between about 30 seconds and about 135 seconds after the completion of step (c).

92. A method for controlling coke oven emissions comprising the steps of:

(a) aligning a one-spot, open-top coke quenching car with a coke oven having a capacity not greater than about 6 meters, (b) providing a coke guide from the coke oven to the car, (c) positioning a fume hood over the car, with the fume hood having a length about equal to the length of the car, (d) pushing hot coke from the coke oven through the coke guide and into the car, (e) withdrawing gases from the fume hood during step (d) and passing said gases to gas cleaning equipment at a gas flowrate of between about 24000 scfmd and about 83600 scfmd, and (f) substantially upon completion of step (e) moving the car from under the fume hood to a quenching station with the hot coke in the car exposed to the atmosphere and without further withdrawal of gases from the hot coke to the gas cleaning equipment.

93. Method according to claim 92 wherein the time for withdrawing gases under step (e) continues for a period of time of between about 30 seconds and about 135 seconds after the completion of step (d).

94. A method for controlling coke oven emissions comprising the steps of:

(a) aligning a one-spot, open-top coke quenching car with a coke oven having a capacity not greater than about 6 meters, (b) providing a coke guide from the coke oven to the car, (c) fitting a fume hood in substantial sealing engagement with the end of the coke guide and the car, (d) pushing hot coke from the coke oven through the coke guide and into the car, (e) withdrawing gases from the fume hood during the step (d) and passing said gases to gas cleaning equipment at a gas flowrate of between about 24000 scfmd and about 83600 scfmd, (f) removing the fume hood from the car, and (g) substantially upon completion of step (e) moving the car to a quenching station with the hot coke in the car exposed to the atmosphere and without further withdrawal of gases from the hot coke to the gas cleaning equipment.

95. Method according to claim 94 wherein the time for withdrawing gases under step (e) continues for a period of time of between about 30 seconds and about 135 seconds after the completion of step (d).

96. A method for controlling coke oven emissions comprising the steps of:

(a) aligning a one-spot, open-top coke quenching car with a coke oven having a capacity not greater than about 6 meters, (b) providing a coke guide from the coke oven to the car, (c) enclosing the coke guide with a fume hood which extends over the top of the car and has a length about equal to the length of the car, (d) pushing hot coke from the coke oven through the coke guide and into the car, (e) withdrawing gases from the fume hood during step (d) and passing said gases to gas cleaning equipment at a gas flowrate of between about 24000 scfmd and about 83600 scfmd, and (f) substantially upon completion of step (e) moving the car from under the fume hood to a quench station with the hot coke in the car exposed to the atmosphere and without further withdrawal of gases from the hot coke to the gas cleaning equipment.

97. The method of claim 96 wherein the time for withdrawing gases under step (e) continues for a period of time between about 30 seconds and about 135 seconds after completion of step (d).

98. A method of controlling coke oven emissions comprising the steps of:

(a) providing a one-spot, coke quenching car having an opening therein to receive hot coke from a coke oven having a capacity not greater than about 6 meters, (b) aligning the opening of the car with a coke guide which extends from the coke oven to the car, (c) pushing hot coke from the coke oven and through the coke guide and the opening in the car, (d) withdrawing gases from the car during step (c) and passing said gases to gas cleaning equipment at a gas flowrate of between about 24000 scfmd and about 83600 scfmd, and (e) substantially upon completion of step (d) moving the car to a quench station with the hot coke in the car exposed to the atmosphere through said opening while withdrawing gases at a rate within a range of zero to a rate at which the net flow of gases escapes through said opening out of the car to the atmosphere.

99. Method according to claim 98 wherein the time for withdrawing gases under step (d) continues for a period of time of between about 30 seconds and about 135 seconds after the completion of step (c).

* * * * *

UNITED STATES PATENT AND TRADEMARK OFFICE

CERTIFICATE OF CORRECTION

PATENT NO. : 4,211,608

DATED : July 8, 1980

INVENTOR(S) : Daniel Kwasnoski et al.

It is certified that error appears in the above—identified patent and that said Letters Patent is hereby corrected as shown below:

Col. 1, line 45, "Even" should read --Each--

Col. 9, line 21, "or" should read --on--.

Col. 21, lines 30 and 31, "ones-pot" should read --one-spot--.

Col. 21, line 51, "open" should read --oven--.

Col. 21, line 56, "over" should read --oven--.

Col. 25, Claim 20, line 9, delete "13, 17" and insert --19, 21, 22, 23, 24, 25, 26, 27, 28, 29, 30, 31, 32, 33, 34, 35, 36, 37, 38 or 39--

Col. 27, claim 51, line 27, after "claim 50" insert --52, 53, 54, 55, 56, 57, 58, 59, 60, 61, 62, 63, 64, 65, 66, 67, 68, 69 or 70--.

Col. 26, claim 42, line 54, claim "41" should read --claim 40--.

Col. 28, claim 65, line 25, "claim 63" should read --claim 62--.

Signed and Sealed this

Fourth Day of November 1980

[SEAL]

Attest:

SIDNEY A. DIAMOND

Attesting Officer

Commissioner of Patents and Trademarks